US006604377B2

(12) United States Patent
Watanabe et al.

(10) Patent No.: US 6,604,377 B2
(45) Date of Patent: Aug. 12, 2003

(54) ELECTRIC REFRIGERATOR

(75) Inventors: Katsumi Watanabe, Kanagawa-ken (JP); Yutaka Kameda, Kanagawa-ken (JP); Masataka Eto, Kanagawa-ken (JP); Susumu Oagu, Kanagawa-ken (JP); Shinjiro Asakura, Kanagawa-ken (JP); Kentaro Shiozaki, Kanagawa-ken (JP); Kenji Haruyama, Kanagawa-ken (JP); Youichi Higashionna, Kanagawa-ken (JP)

(73) Assignee: Fujitsu General Limited, Kawasaki (JP)

( * ) Notice: Subject to any disclaimer, the term of this patent is extended or adjusted under 35 U.S.C. 154(b) by 0 days.

(21) Appl. No.: 09/907,962

(22) Filed: Jul. 19, 2001

(65) Prior Publication Data

US 2002/0023454 A1 Feb. 28, 2002

(30) Foreign Application Priority Data

| | | |
|---|---|---|
| Jul. 21, 2000 | (JP) | 2000-221435 |
| Jul. 28, 2000 | (JP) | 2000-229826 |
| Jul. 28, 2000 | (JP) | 2000-229841 |
| Aug. 11, 2000 | (JP) | 2000-244680 |
| Aug. 11, 2000 | (JP) | 2000-244706 |

(51) Int. Cl.[7] ..... F25D 17/04; F25D 11/02
(52) U.S. Cl. ..... 62/408; 62/444
(58) Field of Search ..... 62/407, 408, 441, 62/444, 285

(56) References Cited

U.S. PATENT DOCUMENTS

| | | | | | |
|---|---|---|---|---|---|
| 2,866,323 | A | * | 12/1958 | Candor | 62/155 |
| 3,115,019 | A | * | 12/1963 | Rutishauser | 34/195 |
| 4,671,074 | A | * | 6/1987 | Gostelow et al. | 62/186 |
| 5,062,272 | A | * | 11/1991 | Burns | 261/DIG. 88 |
| 5,214,936 | A | * | 6/1993 | Lim et al. | 62/407 |
| 5,285,655 | A | * | 2/1994 | Sung-Il et al. | 62/405 |
| 5,388,427 | A | * | 2/1995 | Lee | 165/63 |
| 5,720,185 | A | * | 2/1998 | Lee | 62/329 |
| 5,722,252 | A | * | 3/1998 | Kang et al. | 62/408 |
| 5,784,895 | A | * | 7/1998 | Choi | 62/256 |
| 5,809,799 | A | * | 9/1998 | Jeon | 454/193 |
| 5,875,642 | A | * | 3/1999 | Lee et al. | 62/256 |
| 5,899,089 | A | * | 5/1999 | Kwon | 62/404 |
| 5,979,174 | A | * | 11/1999 | Kim et al. | 62/404 |
| 6,044,654 | A | * | 4/2000 | Igari et al. | 236/49.3 |
| 6,062,037 | A | * | 5/2000 | Yoon | 62/407 |
| 6,094,931 | A | * | 8/2000 | Jeong | 454/193 |
| 6,170,276 | B1 | * | 1/2001 | Mandel et al. | 62/187 |

* cited by examiner

*Primary Examiner*—William C. Doerrler
(74) *Attorney, Agent, or Firm*—Kanesaka & Takeuchi

(57) ABSTRACT

A chill blow-off port is provided on a front surface side within a refrigerating compartment, and a chill return port is provided on a back wall of the refrigerating compartment, so that a chill generated by a heat exchanger flows from the front surface side within the refrigerating compartment toward the rear in the depth. Thereby, temperature unevenness within the refrigerating compartment is effectively eliminated and a cooling rate of a preserved food is enhanced.

34 Claims, 38 Drawing Sheets

ELECTRIC REFRIGERATOR

TECHNICAL FIELD

The present invention relates to an electric refrigerator, and more particularly to a technique for eliminating temperature unevenness within a refrigerating compartment to improve a food preservation state.

BACKGROUND ART

In many cases, an electric refrigerator has several storing compartments such as a refrigerating compartment, a vegetable compartment and a freezer compartment, which are set at different temperature zones. One example will be described with reference to FIG. 40. In recent years, the electric refrigerator is constructed such that are frigerating compartment 100 having the highest frequency of use from a human engineering point of view is placed at its uppermost stage, and at its lower stages, a switchable compartment 200 such as a chilled compartment, a vegetable compartment 300 and a freezer compartment 400 are placed. The temperature in the switchable compartment 200 is made selectively adjustable between a freezing temperature zone and a refrigerated temperature zone in accordance with a contained object such as a chilled food.

A chill, i.e. chilled air, is generated by a heat exchanger (evaporator) 1 connected to a compressor C, and the chill is supplied to each storing compartment 100 to 400 through a duct 3 by a blower 2. A housing for the main body R of the electric refrigerator consists of an inner case 4 and an outer case 5 which have been assembled with thermal insulting material interposed therebetween, and on the back surface side within its compartment, between the back surface and the inner case 4, there is provided a duct cover 9 forming the duct 3, and the heat exchanger 1 and the blower 2 are disposed within the duct 3.

Since the duct 3 is provided on a back surface side of the main body R of the refrigerator, the chill is supplied to the refrigerating compartment 100 and the switchable compartment (for example, chilled compartment) 200 and the like from their back surfaces, and is returned to a suction side of the heat exchanger 1 through a predetermined chill return duct.

In this respect, in this example, the chill supplied to the refrigerating compartment 100 is conducted into the vegetable compartment 300 through a by-pass pipe 6, and thereafter, is to be returned to the suction side of the heat exchanger 1. When the vegetable compartment 300 is placed under the refrigerating compartment 100, however, on a partition wall between the refrigerating compartment 100 and the vegetable compartment 300, the is provided a ventilation port in such a manner that the chill is supplied from the refrigerating compartment 100 to the vegetable compartment 300.

Since it has adopted a back surface blow-off system in which the chill is supplied from the back surface side of the storing compartment, a conventional electric refrigerator has had the following problem. That is, as regards the storing compartment 100, since its shelf plates are filled with foods in the majority of cases, they become an obstacle to supply of chill, thus making it difficult to cool the front surface side of the refrigerating compartment 100.

Not only that, but also the refrigerating compartment 100 is kept in a substantially hermetically-sealed state by a door D, but heat always enters through its gasket portion. Since the door D of the refrigerating compartment 100 is frequently opened and closed, particularly on the front surface side of the refrigerating compartment 100, heat is heavily moved in and out. From these reasons, between the back surface side and the front surface side of the refrigerating compartment 100, there has been caused temperature unevenness.

Also, among each storing compartment, the refrigerating compartment 100 requires the largest amount of chill, but the heat exchanger 1 is arranged below the duct 3 because of relationship with the compressor C and a duct course until the chill reaches the refrigerating compartment 100 is long. Therefore, the chill becomes higher in temperature due to heat exchange with the outside in a process, in which the chill moves, and chill loss caused by this movement is also great.

Further, the above-described conventional chill circulation system has had the following problems. First, as regards the vegetable compartment 300, since the chill is supplied from the refrigerating compartment 100 on the upstream side, its temperature depends upon a temperature of the refrigerating compartment 100, and delicate temperature control cannot only be performed, but also an offensive smell unique to the refrigerating compartment is brought about to the vegetable compartment 300 together with the chill.

Also, in recent years, in order to properly store in accordance with kind of vegetable, it has been proposed to partition the vegetable compartment 300 into a high-temperature vegetable compartment and a low-temperature vegetable compartment, but in the above-described conventional chill circulation system, it is difficult to produce high temperature and low temperature, and in order to realize them, a considerably high technique is required.

SUMMARY OF THE INVENTION

According to the present invention, it is possible to eliminate particularly temperature unevenness within the refrigerating compartment, and to effectively cool preserved foods with less chilled air loss.

Also, according to the present invention, a temperature within each storing compartment can be individually controlled independently of other storing compartment temperature. Particularly, in the case where the vegetable compartment is partitioned into a low-temperature vegetable compartment and a high-temperature vegetable compartment, it is possible to adjust temperature within each compartment individually and appropriately. For this reason, the present invention has several special features to be described hereinafter.

First, in the present invention, a storing compartment capable of being opened or closed by a door is included and a chill, i.e. chilled air, generated by a heat exchanger flows from a front surface side facing the door within the storing compartment toward the rear in the depth.

In this case, even if the storing compartment is arranged not at the upper stage, but at the intermediate stage of the main body of the refrigerator, the present invention is applicable. That is, when the storing compartment is arranged, for example, at the intermediate stage of the main body of the refrigerator, a duct can be drawn into its inside partition wall so as to blow out the chill from the front surface side of the storing compartment.

In the present invention, the storing compartment is preferably a refrigerating compartment, and when the refrigerating compartment is arranged at the upper stage of the main body of the refrigerator, between an inner case and an outer case, a duct is formed from the back surface side of the compartment over the top surface side; at one end of the duct on the top surface side, there is provided a chill blow-off port, which is opened in the upper portion of the front surface of the refrigerating compartment on the door side; and the back wall of the refrigerating compartment is formed with a first chill return port communicating to the duct, whereby the chill can be flowed from the front surface side within the refrigerating compartment toward the rear in the depth.

When the vegetable compartment is arranged in the lower part of the refrigerating compartment, it may be possible to form a second chill return port communicating to the duct on the back wall of the vegetable compartment so as to supply the chill into the vegetable compartment through the refrigerating compartment. Also, it may be possible to supply the chill into the vegetable compartment through the dedicated duct and to return the chill within the vegetable compartment from its first chill return port to the duct through the refrigerating compartment, and either of these aspects is also included in the present invention.

In this case, facing a chill passage to be formed between the vegetable compartment and the refrigerating compartment, it is preferable to provide deodorizing means. Also, apart from this, on the suction side of the heat exchanger, there is provided deodorizing means, whereby the chill circulating within the compartment can be effectively deodorized. In this respect, the deodorizing means preferably contains an anti-fungus agent.

Within the duct, there are contained the blower and the heat exchanger, and according to a preferred aspect of the present invention, in order to shorten a supplying course for the chill, the blower and the heat exchanger are arranged in the upper part of the refrigerating compartment on the back surface side.

The interior of the refrigerating compartment is partitioned into a plurality of storage portions in multistage by means of shelf plates, and when the blower and the heat exchanger are arranged in the upper part of the refrigerating compartment on the back surface side, it is advisable to provide the first chill return port in a storage portion at a lower stage except a storage portion at the uppermost stage, and to cause the storage portion at the uppermost stage to communicate to the storage portion at the next stage through a ventilation port.

The above-described ventilation port may also be a clearance having a predetermined width provided between the shelf plate at the uppermost stage and the back wall of the refrigerating compartment, and it is preferable to upwardly curve a rear end of the shelf plate at the uppermost stage at a predetermined curvature for forming a ventilation port in the curved portion, or to provide a side wall having a predetermined width, upwardly protruding like a U-character in cross section at the rear end of the shelf plate at the uppermost stage for forming a ventilation port on the top surface of the side wall, and it is possible to thereby prevent water drops from falling.

In the case where within the duct, the blower and the heat exchanger are arranged in the upper part of the refrigerating compartment on the back surface side; in the lower part of the refrigerating compartment, there is arranged a vegetable compartment, into which a chill from the refrigerating compartment is supplied; and the back wall of the vegetable compartment is also formed with a second chill return port communicating to the duct. According to the special feature of the present invention, in order to facilitate control of wind pressure, the back surface duct within the duct is divided into a refrigerating compartment return duct for conducting a chill from the refrigerating compartment to the suction side of the heat exchanger, and a vegetable compartment return duct for conducting a chill from the vegetable compartment to the suction side of the heat exchanger. In this case, a sectional area of the vegetable compartment return duct is preferably larger than that of the refrigerating compartment return duct.

The interior of the refrigerating compartment is partitioned into a plurality of storage portions in multistage by means of shelf plates, and according to the present invention, in order to make temperatures among the storage portions as uniform as possible, each of at least second stage and subsequent storage portions from above is provided with a first chill return port on its both left and right sides; correspondingly thereto, refrigerating compartment return ducts are provided on both left and right sides of the back surface duct; and therebetween, a vegetable compartment return duct is arranged.

The interior of the refrigerating compartment return duct may be further subdivided for each first chill return port of each storage portion, and it is possible to thereby delicately control wind pressure within the refrigerating compartment return duct and to make temperatures among the storage portions further uniform.

According to a preferred aspect of the present invention, each first chill return port to be provided for the refrigerating compartment is attached with a hood for directing a chill to be returned from within the refrigerating compartment to the suction side of the heat exchanger to prevent any occurrence of turbulence.

Also, according to another special feature of the present invention, in order to eliminate temperature unevenness in the storage portion at the uppermost stage partitioned by means of the shelf plate within the refrigerating compartment, the upper wall of the storage portion at the uppermost stage is also provided with a third chill return port communicating to the top surface duct within the duct. In this case, the third chill return port is preferably provided with a hood for directing the chill to be returned to the top surface duct from within the storage portion at the uppermost stage to the chill blow-off port side.

In this respect, it may be possible to divide the interior of the top surface duct into a chill supply duct extending from the air supply side of the heat exchanger toward the chill blow-off port, and a chill return duct for conducting the chill returned from the third chill return port to the suction side of the heat exchanger for returning the chill from the storage portion at the uppermost stage to the suction side of the heat exchanger. Even in this case, the third chill return port may be provided with a hood for directing the chill to be returned to the top surface duct from within the storage portion at the uppermost stage toward the suction side of the heat exchanger.

The present invention also includes an aspect in which in the lower part of the refrigerating compartment, there is arranged a vegetable compartment, into which a chill is supplied from the refrigerating compartment; on the back wall of the vegetable compartment, there is also formed a second chill return port communicating to the duct; and the blower and the heat exchanger are arranged on the back surface side of, for example, the vegetable compartment in the lower part within the back surface duct of the duct. In this case, the interior of the back surface duct is to be divided into a chill supply duct extending from the air supply side of the heat exchanger toward the chill blow-off port, and a refrigerating compartment return duct for conducting the chill from the first chill return port of the refrigerating compartment to the suction side of the heat exchanger.

Contrary to this, it may be possible to divide the interior of the back surface duct into a first chill supply duct extending from the air supply side of the heat exchanger toward the chill blow-off port, and a second chill supply duct for conducting the chill from the first chill return port of the refrigerating compartment toward the chill blow-off port in the same manner.

In this aspect, the sectional area of the chill supply duct is preferably made larger than that of the refrigerating compartment return duct. In this respect, the chill in the vegetable compartment is conducted from the second chill return port to the suction side of the heat exchanger.

Also, even in an aspect in which the blower and the heat exchanger are arranged in the lower part within the back surface duct of the duct, of a plurality of storage portions partitioned by shelf plates within the refrigerating compartment, it is preferable to provide each of at least second stage and subsequent storage portions from above with a first chill return port on its both left and right sides, to provide a refrigerating compartment return duct each on both left and right sides of the back surface duct, and to arrange a chill supply duct therebetween. Also, the upper wall of the storage portion at the uppermost stage may be provided with a third chill return port communicating to the top surface duct within the duct.

As another aspect, it may be possible to divide the interior of the duct into a first chill supply duct extending from the air supply side of the heat exchanger toward the chill blow-off port, and a second chill supply duct for conducting the chills from the first chill return port and the third chill return port toward the chill blow-off port.

Also, as still another aspect, it is also possible to divide the interior of the duct into a chill supply duct extending from the air supply side of the heat exchanger toward the chill blow-off port, and a chill return duct for conducting the chills from the first chill return port and the third chill return port toward the suction side of the heat exchanger.

As further aspect, it may be possible to conduct the chill from the third chill return port to the chill blow-off port side, and to conduct the chill from the first chill return port to the suction side of the heat exchanger. In this case, between the chill supply duct including the third chill return port and the chill return duct including the first chill return port, there is provided a shielding plate.

In this respect, in each of the above-described aspects, the duct has been divided in the lateral direction, but it is also possible to divide in a back-and-forth direction as viewed from the compartment side in some cases.

A more specific feature of the present invention is that in an electric refrigerator in which the interior of a compartment is partitioned into a plurality of space in multistage by means of partition walls; space at the uppermost part is allocated to a refrigerating compartment; and space in the lower parts is used for other storing compartments such as a vegetable compartment and a freezer compartment, in the upper part of the refrigerating compartment on the back surface side there are arranged a blower and a heat exchanger; and a part of a chill to be supplied from the blower is conducted to at least the vegetable compartment through a dedicated duct.

According to a preferred aspect of the present invention, within compartments of the main body of the refrigerator, there are included a back surface duct and a top surface duct which have been continuously formed from their back surface side over the top surface side; at one end of the top surface duct, there is provided a duct having a chill blow-off port, which is opened within the refrigerating compartment; in the upper part of the refrigerating compartment on the back surface side within the same duct, there are arranged a blower and a heat exchanger; at least into the vegetable compartment, a part of a chill to be supplied from the blower is conducted through a dedicated duct; and the chill in each compartment is returned to the heat exchanger side through the back surface duct.

Even in this case, a chill blow-off port for the top surface duct is arranged in the upper part of the front surface of the refrigerating compartment; the back wall of the refrigerating compartment is formed with a chill return port communicating to the back surface duct, whereby it is possible to flow the chill from the front surface side within the refrigerating compartment toward the rear in the depth, making it possible to eliminate any temperature unevenness within the refrigerating compartment.

When a switchable compartment (for example, chilled compartment) is allocated to one of the storing compartments, a part of the chill to be supplied from the blower is preferably supplied also into the switchable compartment through a dedicated duct. In this case, the dedicated duct may be used for both the vegetable compartment and the switchable compartment as a mixing duct; and a dedicated duct for the vegetable compartment and a dedicated duct for the switchable compartment may be separately provided. Either of those aspects is included in the present invention.

In the present invention, there are several methods to guide through the dedicated duct, and when the dedicated duct is formed on the back surface of the duct cover through the use of thermal insulating material, the dedicated duct can be conducted to the vegetable compartment or the switchable compartment through within the back surface duct.

When the dedicated duct is arranged in the corner of an inner case forming the compartment, the inner case can be utilized as one portion of the same dedicated duct, and the cost can be reduced. In this respect, the dedicated duct may be arranged along the side within the compartment.

For the blower, across flow fan is used, and according to the present invention, at a portion of the air supply port on one end side, there is arranged one end of the dedicated duct, and the same dedicated duct is caused to pass through along the side of the heat exchanger and is conducted downward. Thereby, the dedicated duct can be provided without reducing the internal capacity of the compartment, and its duct area can be also taken large. Apart from this, it may be possible to conduct the dedicated duct downward by passing it through forward of the heat exchanger, and in this case, heat in the heat exchanger can be transmitted to the dedicated duct.

A part of the chill to be supplied from the blower is conducted into the vegetable compartment or the switchable compartment through the dedicated duct, and the remainder is conducted to the chill blow-off port through the top surface duct, and according to the present invention, within the top surface duct, there is provided a first chill guide plate for making the chill to be blown out from the chill blow-off port uniform.

Also, according to a preferred aspect of the present invention, in order to achieve efficient chill circulation, between the heat exchanger and the suction port of the blower, there is provided a second chill guide plate for conducting a part of the chill generated by the heat exchanger to the suction port of the dedicated duct to be arranged on end side of the blower.

When the interior of the vegetable compartment is partitioned into a low-temperature vegetable compartment and a high-temperature vegetable compartment through a partition wall, the chill is supplied to each of the vegetable compartments through their respective different dedicated ducts. In this case, it is possible to delicately perform temperature control in the low-temperature vegetable compartment and the high-temperature vegetable compartment.

According to another special feature of the present invention, in the dedicated duct of the high-temperature vegetable compartment, a portion of condensation pipe is guided through with the aim of preventing condensation and regulating temperature. Also, in the dedicated duct for the high-temperature vegetable compartment, there is arranged a control circuit substrate having heating components.

In order to enable delicate temperature adjustment, at least one of the dedicated ducts is preferably provided with a shutter for adjusting an amount of chill supplied for the low-temperature vegetable compartment or the high-temperature vegetable compartment.

DETAILED DESCRIPTION

Figure 1:
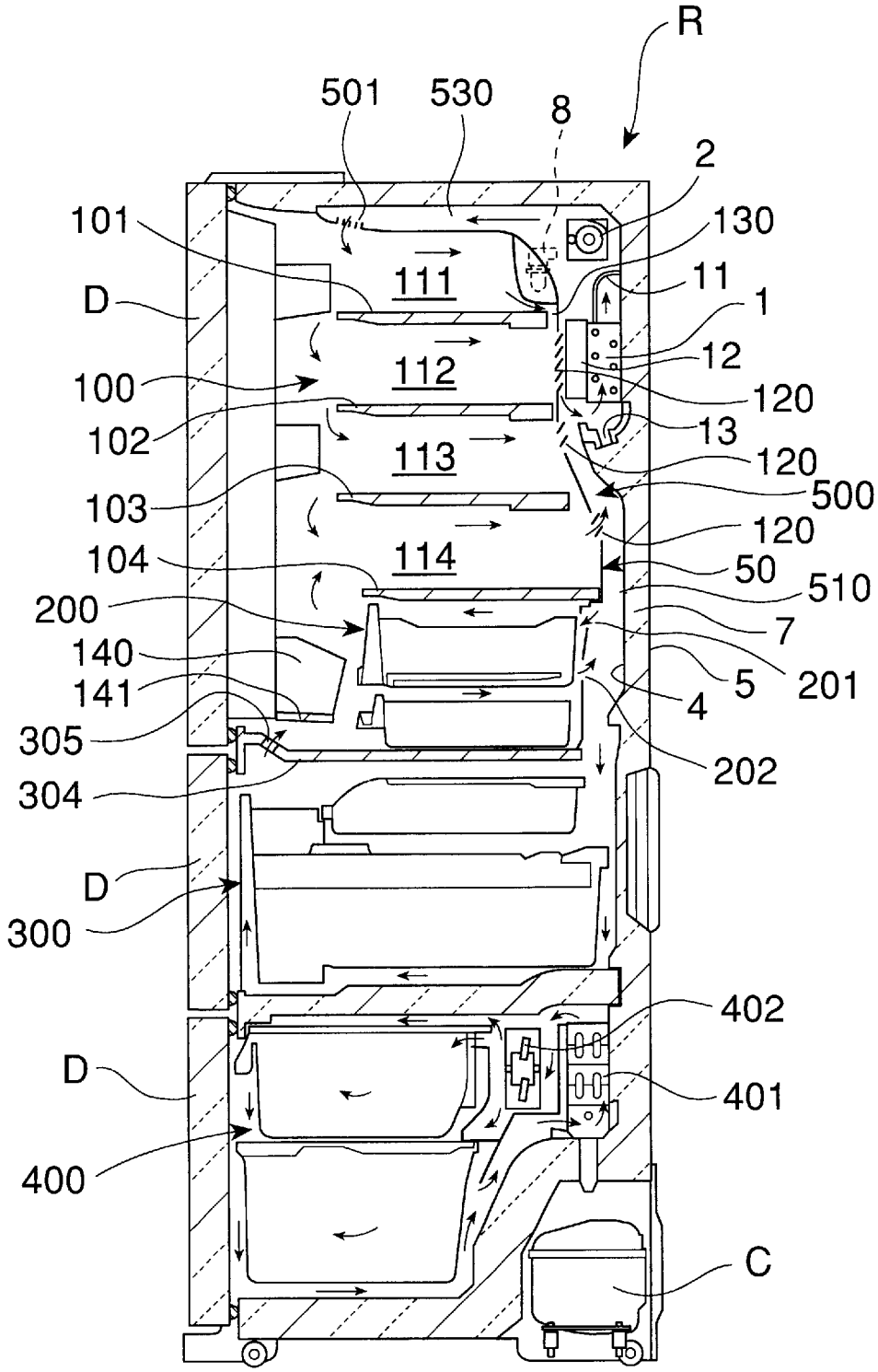
FIG. 1 is a sectional view showing a first embodiment according to the present invention.
Figure 2:
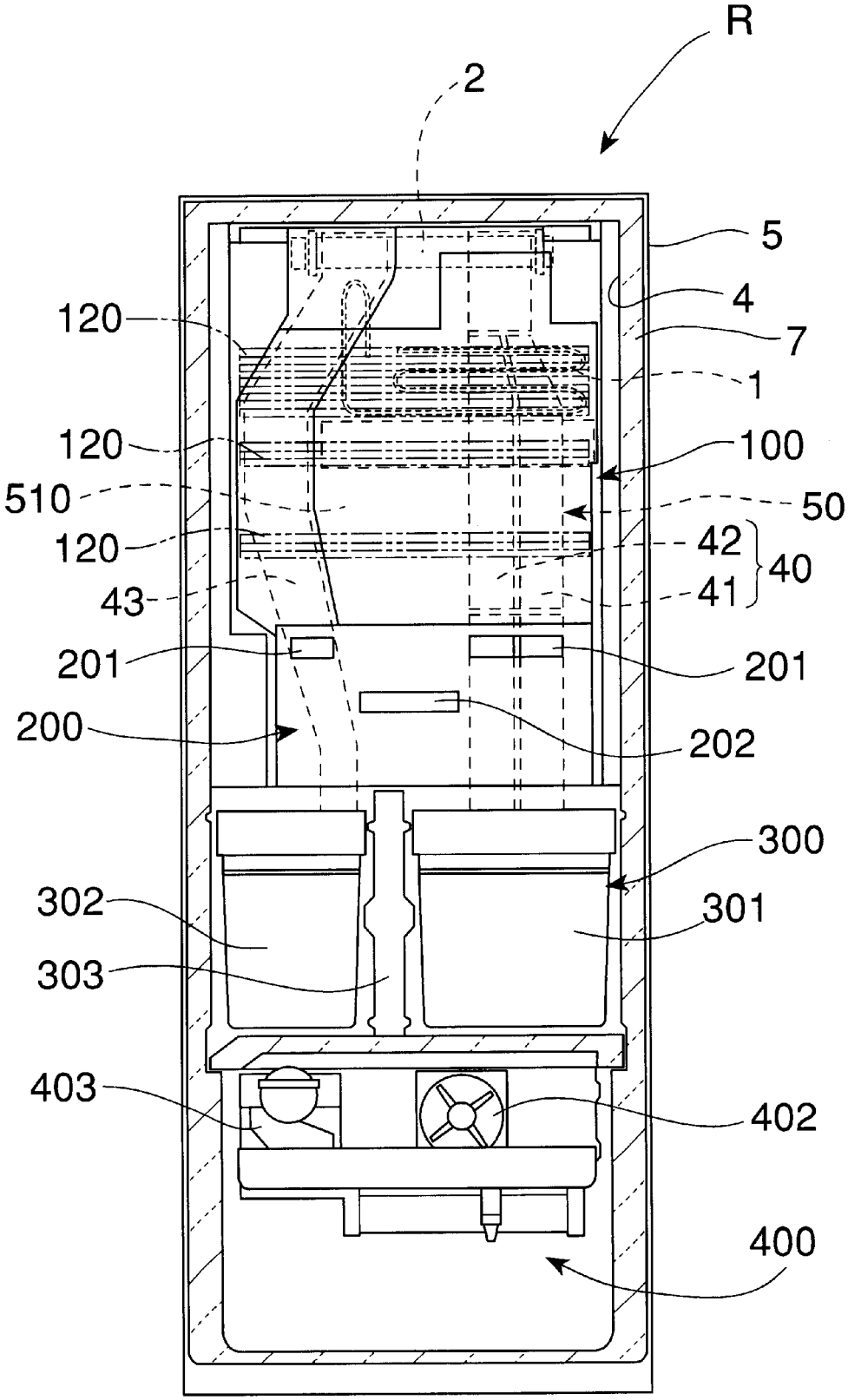
FIG. 2 is a front view when an interior of the first embodiment is viewed from a door side.

First, with reference to FIGS. 1 to 5, the description will be made of the first embodiment as a basis of the present invention. In this respect, FIG. 1 is a sectional view showing a main body R of an electric refrigerator according to the present invention, and FIG. 2 is a front view when the interior of the main body R of the refrigerator is viewed from the door side.

According to these figures, within the main body R of the refrigerator, there are arranged a refrigerating compartment 100, a switchable compartment 200, a vegetable compartment 300 and a freezer compartment 400 in order from above. In this respect, in the first embodiment, since the switchable compartment 200 has been allocated to one portion within the refrigerating compartment 100, a door D is attached to each storing compartment except the switchable compartment 200. The temperature in the switchable compartment 200 is made selectively adjustable between a freezing temperature zone and a refrigerated temperature zone in accordance with a contained object such as a chilled food.

The main body R of the refrigerator includes an inner case 4 and an outer case 5, and therebetween there is filled foam thermal insulating material 7. The freezer compartment 400 is an independent compartment of other storing compartments, and is provided with a heat exchanger (evaporator) 401, a blower 402, an icemaker 403 and the like, which are for dedicated use with the freezer compartment 400. In the lower part behind the freezer compartment 400, there is arranged a compressor C.

Within the main body R of the refrigerator, there is provided a duct cover 50 forming a duct 500 between the duct cover 50 and the inner case 4, and in the present invention, the duct cover 50 is continuously formed from the back surface side of the main body R of the refrigerator over the top surface.

Figure 3:
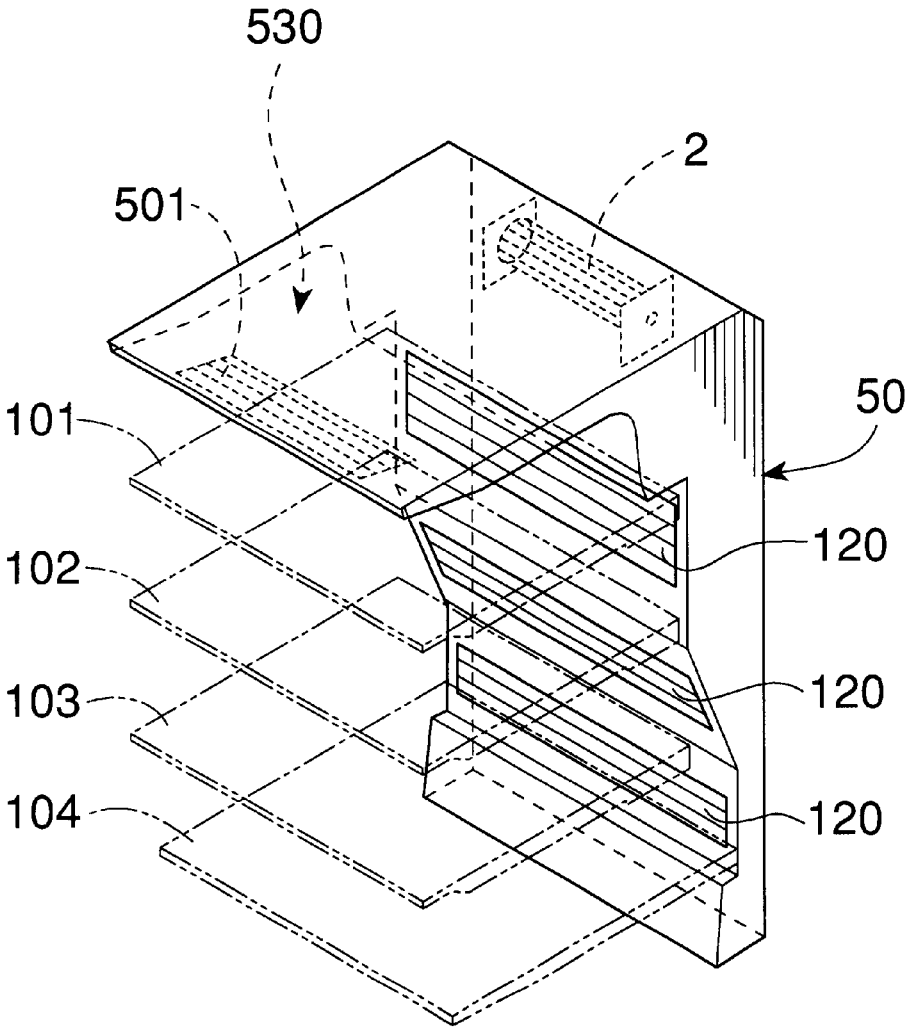
FIG. 3 is a perspective view showing a duct installed in the first embodiment.

In this first embodiment, the duct 500 includes a back surface duct 510 located on the back surface side of the refrigerating compartment 100 including the switchable compartment 200, and a top surface duct 530 extending from above the back surface duct 510 to the front surface side facing the door D of the refrigerating compartment 100, and at an end portion of the top surface duct 530, there is formed a chill blow-off port 501. FIG. 3 shows a perspective view in which the duct cover 50 has been extracted.

Within the duct 500, there are provided the heat exchanger (evaporator) 1 and the blower 2, and in this first embodiment, the heat exchanger 1 and the blower 2 are provided in the upper part of the refrigerating compartment 100 on the back surface side. For the blower 2, a cross flow fan is used. The heat exchanger 1 is connected to the compressor C through piping 1*a*, and on the refrigerating compartment 100 side of the heat exchanger 1, thermal insulating material 12 is attached. Also, in the lower part of the heat exchanger 1, there is provided a drain outlet 13, and in the upper part of the refrigerating compartment 100 on the back surface side, there is provided a compartment lamp 8.

According to this first embodiment, the interior of the refrigerating compartment 100 is partitioned into four storage portions 111 to 114 by means of four shelf plates 101 to 104. The shelf plate 104 at the lowest stage is utilized as a ceiling plate for the switchable compartment 200. On a back wall of the refrigerating compartment 100, there is provided a chill return port communicating to the duct 500, but in this first embodiment, since there is the blower 2 on the back surface side of the storage portion 111 at the uppermost stage, it is not preferable to provide the storage portion 111 at the uppermost stage with the chill return port. In this respect, the back wall of the refrigerating compartment 100 including each storage portion 111 to 114 is actually formed of the duct cover 50.

Thus, with the exception of the storage portion 111 at the uppermost stage, each back wall of the other storage portions 112, 113 and 114 is provided with a chill return port (first chill return port) 120. As regards the storage portion 111 at the uppermost stage, at the rear end of the shelf plate 101, there is provided a clearance between the shelf plate 101 and the back wall of the refrigerating compartment 100 in such a manner that the storage portion 111 at the uppermost stage communicates to the storage portion 112 at the next stage with this clearance as a ventilation port 130.

Figure 4:
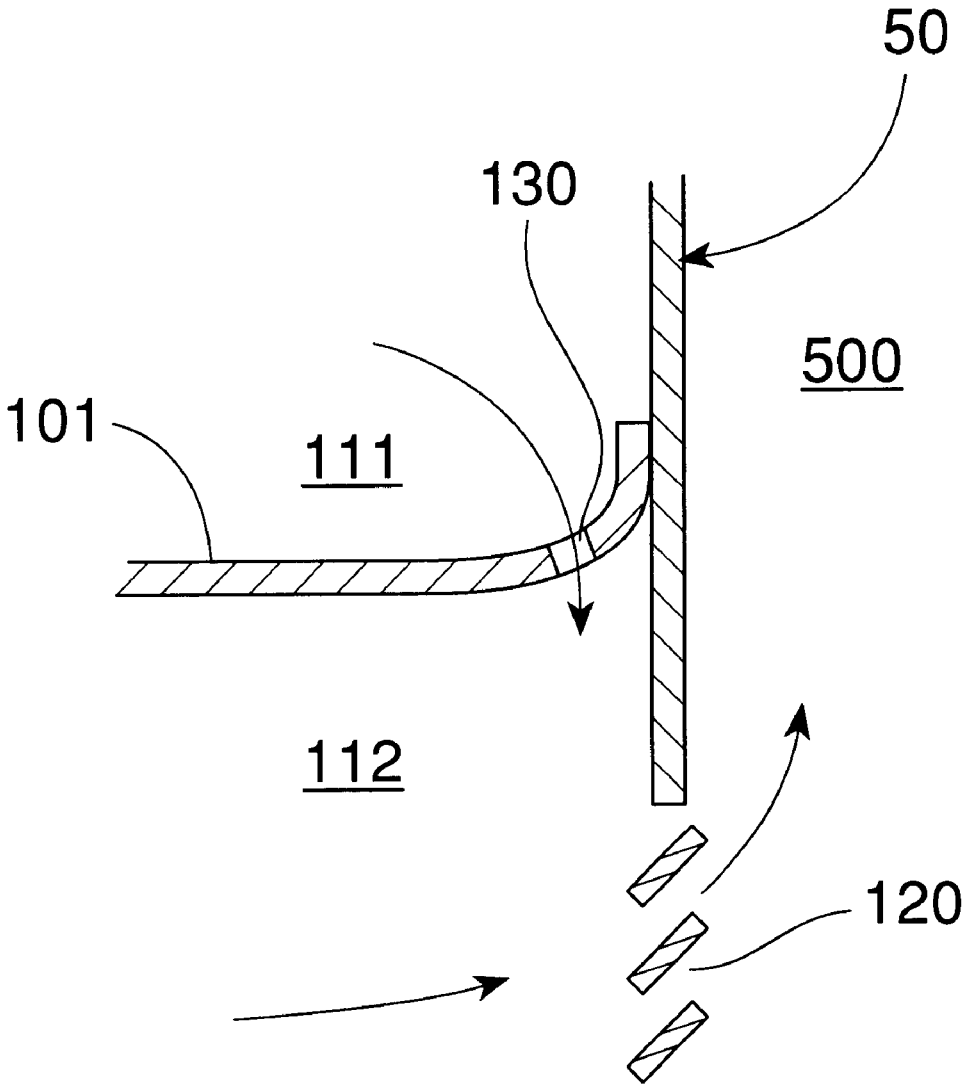
FIG. 4 is a sectional view showing a preferred embodiment for a shelf plate according to the first embodiment.
Figure 5:
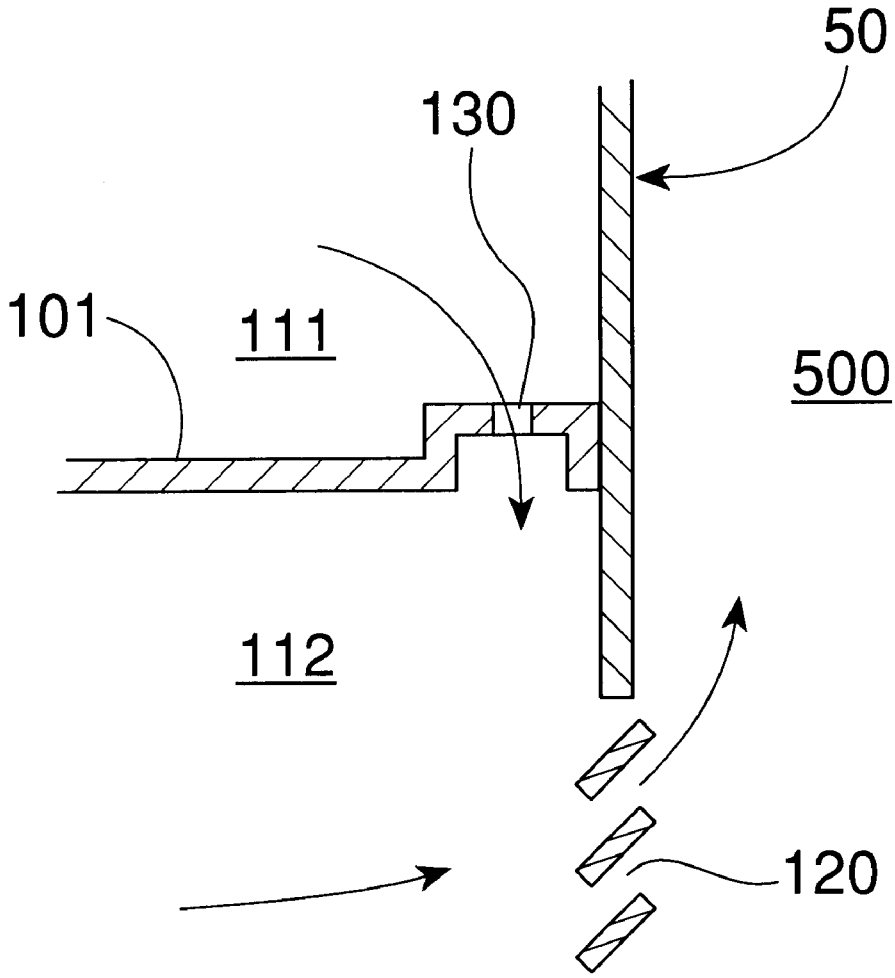
FIG. 5 is a sectional view showing another preferred embodiment for a shelf plate according to the first embodiment.

In this respect, in order to prevent water-drops from leaking from the ventilation port 130, a rear end of the shelf plate 101 can be curved upwardly at a predetermined curvature to provide the curved portion with the ventilation port 130 as preferably shown in FIG. 4. Also, as shown in FIG. 5, the rear end of the shelf plate 101 can be made into a side plate protruded like a U-character in cross section to provide the ventilation port 130 on the top surface of the side plate.

According to this first embodiment, into the switchable compartment 200 and the vegetable compartment 300, a chill, i.e. chilled air, is supplied through a dedicated duct 40 for extending downward from the blower 2 as shown in FIG. 2. In this first embodiment, since the vegetable compartment 300 is partitioned into a low-temperature vegetable compartment 301 and a high-temperature vegetable compartment 302, two dedicated ducts 41 and 42 are provided for the low-temperature vegetable compartment 301, and one dedicated duct 43 is provided for the high-temperature vegetable compartment 302.

In this first embodiment, each dedicated duct 41 to 43 is formed on the back surface side of the duct cover 50 using thermal insulating material, and is conducted from an air supply port portion of the blower 2 to the back surface side of the vegetable compartment 300 through within a back surface duct 510. On its way, there is opened a chill supply port 201 for the switchable compartment 200. In other words, the dedicated ducts 41 to 43 are used both for the vegetable compartment 300 and the switchable compartment 200 as a mixing duct. On the back wall (duct cover 50) of the switchable compartment 200, there is formed a chill return port 202 communicating to the back surface duct 510.

On the front surface side (door D side) of an inside partition wall 304 for partitioning into the refrigerating compartment 100 and the vegetable compartment 300, there is formed a ventilation port 305 for returning a chill within the vegetable compartment 300 to the refrigerating compartment 100 side. In other words, a chill supplied to the back surface side of the vegetable compartment 300 through the dedicated duct 40 moves to the front surface side to reach the refrigerating compartment 100 from the ventilation port 305, and is returned to the duct 500 from the chill return port 120 of the refrigerating compartment 100.

Since the chill within the vegetable compartment 300 may possibly have an offensive smell unique to vegetables, there is preferably arranged deodorizing means facing a chill passage from the vegetable compartment 300 to the refrigerating compartment 100. For this reason, in this first embodiment, there is attached a deodorant 141 on the base side of a door case 140 located substantially right above the ventilation port 302. A part from this, a deodorant made into, for example, a honey comb shape may be fitted into the ventilation port 302.

The description will be made of a movement of the chill within the refrigerating compartment 100. A chill generated by the heat exchanger 1 is blown out from a chill blow-off port 501 provided at the tip end of the top surface duct 530 to the front surface side of the refrigerating compartment 100 by the operation of the blower 2 to pass through each storage portion 111 to 114 reaching their back surface side, and is returned to the back surface duct 510 through a chill return port 120.

According to this chill blowing-out system, since the front surface side of the refrigerating compartment 100, in which temperature is most prone to be raised, is first cooled, it is possible to make the temperature within the entire refrigerating compartment 100 uniform even if each storage portion 111 to 114 is filled with foods.

As regards the switchable compartment 200, the chill is supplied through each chill supply port 201 of the dedicated ducts 41 to 43, and since the chill return port 202 is formed on the back wall, almost all chills are returned to the back surface duct 510 from the back wall side after they are circulated within the switchable compartment 200.

In this respect, when the refrigerating compartment 100 is arranged, for example, at the intermediate stage of the main body R of the refrigerator unlike the first embodiment, the duct can be drawn into its inside partition wall to blow out the chill from the front surface side of the refrigerating compartment 100 in the same manner as described above for returning the chill from the back surface side.

Since into the switchable compartment 200 and the vegetable compartment 300, the chill is directly supplied through the dedicated duct 40 without going through other refrigerating compartments, it becomes possible to perform delicate temperature control. Particularly to the low-temperature vegetable compartment 301 and the high-temperature vegetable compartment 302, another dedicated duct is connected respectively and therefore, it is possible to obtain a preset temperature quickly and accurately.

For example, temperature within the low-temperature vegetable compartment 301 is set to 1 to about 2° C. for vegetables such as green vegetables like spinach and leeks, for which low-temperature preservation is made preferable, while temperature for the high-temperature vegetable compartment 302 is set to 7 to about 10° C. for preservation of southern fruits such as bananas and pineapples.

In this respect, since almost all chills in each compartment are returned to the heat exchanger 1 through the back surface duct 510 as described above, there is provided a deodorant (not shown) on the suction side of the heat exchanger 1, whereby it is possible to effectively deodorize the chills which circulate within the compartment. The deodorant to be provided on the suction side of the heat exchanger 1 may be the same as the deodorant 141, and preferably contains an anti-fungus agent.

Next, with reference to FIGS. 6 to 24, the description will be made of another embodiment according to the present invention. Elements identical or maybe regarded as identical to those in the first embodiment are designated by the identical reference numerals. Also, each of these figures is aschematic figure, and in other embodiments to be described hereinafter, illustration of the freezer compartment will be omitted.

Figure 6:
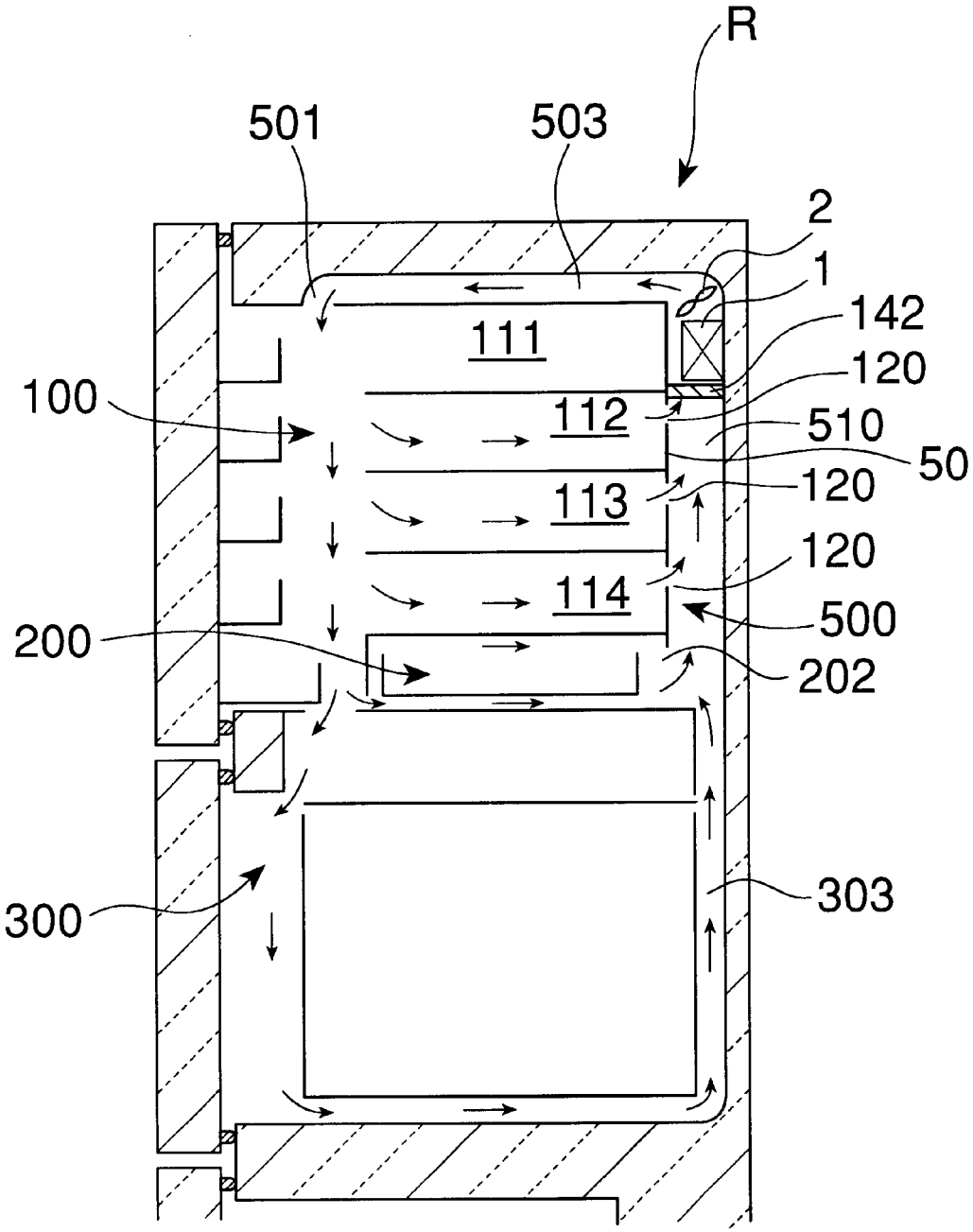
FIG. 6 is a sectional view schematically showing a second embodiment according to the present invention.
Figure 7:
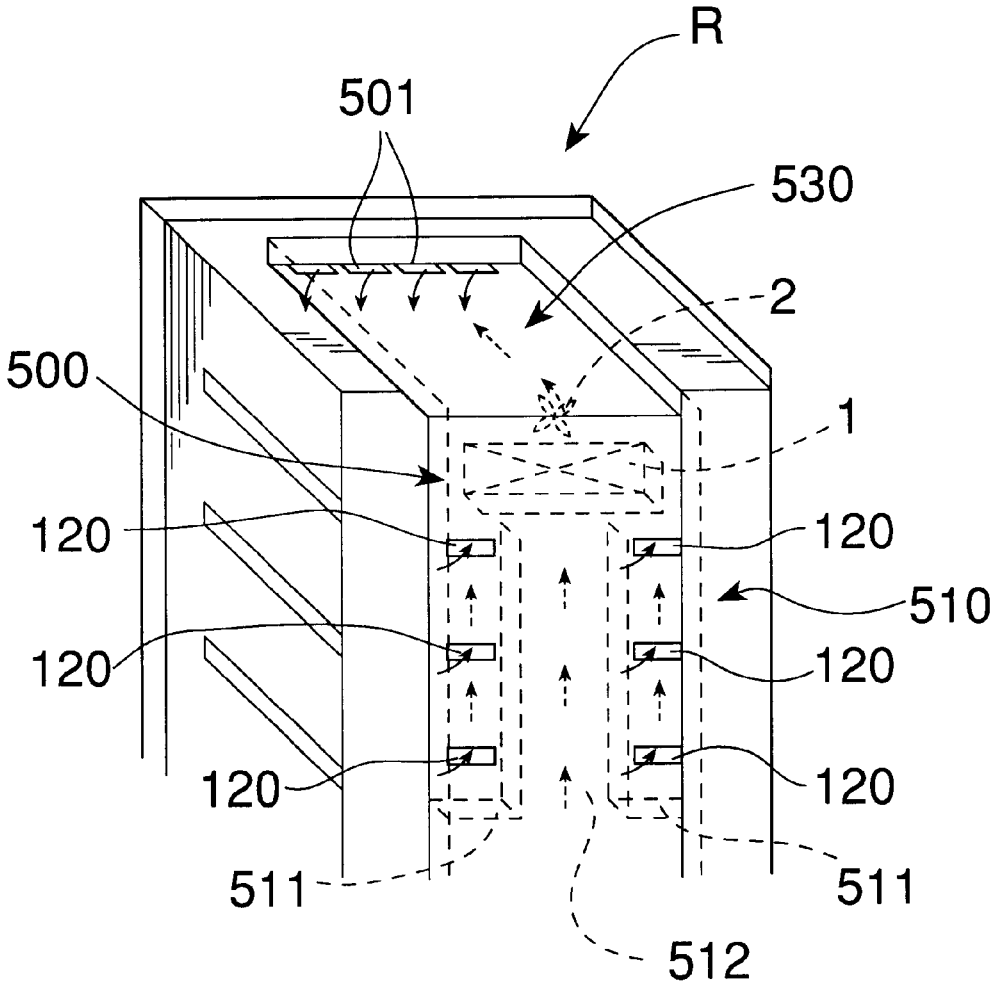
FIG. 7 is a perspective view showing a back surface side according to the second embodiment.

First, the second embodiment of FIGS. 6 and 7 is mainly different from the first embodiment in that the chills are supplied to the vegetable compartment 300 from the refrigerating compartment 100 instead of the dedicated duct and on the back surface side of the vegetable compartment 300, there is provided a chill return port (second chill return port) 303 for communicating to the duct 500, and that the chills are also supplied to the switchable compartment 200 from the refrigerating compartment 100.

In this respect, the heat exchanger 1 and the blower 2 are arranged within the duct 500 in the upper part on the back surface side of the refrigerating compartment 100 in the same manner as in the first embodiment, and in this case, on the suction side of the heat exchanger 1, there is provided the deodorant 142.

In this second embodiment, in order to mainly eliminate any difference in temperature among the storage portions 112 to 114, chill return ports 120 are provided on the both left and right sides of each storage portion 112 to 114 as shown in the back surface side perspective view of FIG. 7.

Correspondingly thereto, the back surface duct 510 within the duct 500 covers a line of each chill return port 120 located on the left side and a line of each chill return port 120 located on the right side respectively, and is divided into refrigerating compartment return ducts 511 and 511 for guiding return chills on the suction side of the heat exchanger 1, and a vegetable compartment return duct 512 for guiding chills from the chill return port 303 of the vegetable compartment 300 to the suction side of the heat exchanger 1. In this respect, the chills from the chill return port 202 of the switchable compartment 200 are returned to the suction side of the heat exchanger 1 through the vegetable compartment return duct 512.

The vegetable compartment return duct 512 is provided between the refrigerating compartment return ducts 511 and 511, and from the view point of balance of pressure on the suction side of the heat exchanger 1, a sectional area of the vegetable compartment return duct 512 is preferably larger than a total sectional area of the refrigerating compartment return ducts 511 and 511.

Figure 8:
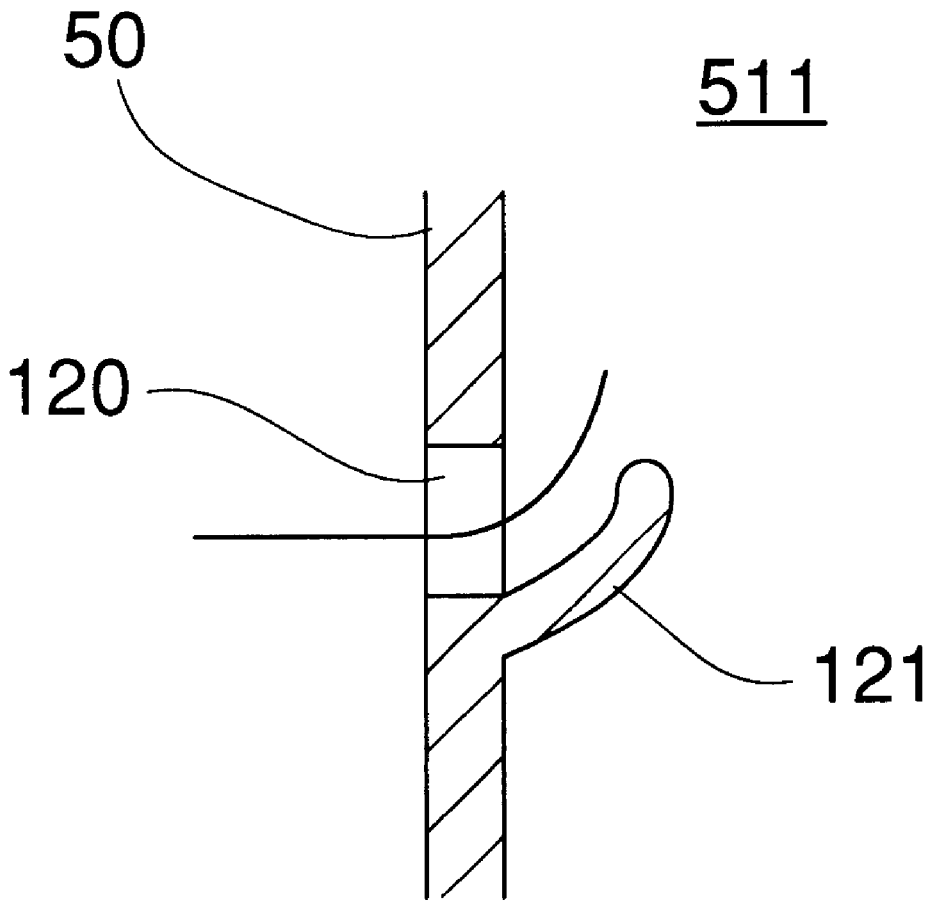
FIG. 8 is a partial enlarged sectional view showing the second embodiment.

Also, in order to prevent occurrence of turbulence within the refrigerating compartment return ducts 511 and 511, as shown in FIG. 8, each chill return port 120 is preferably provided with a hood 121 for directing a chill return direction to the suction side of the heat exchanger 1.

Figure 9:
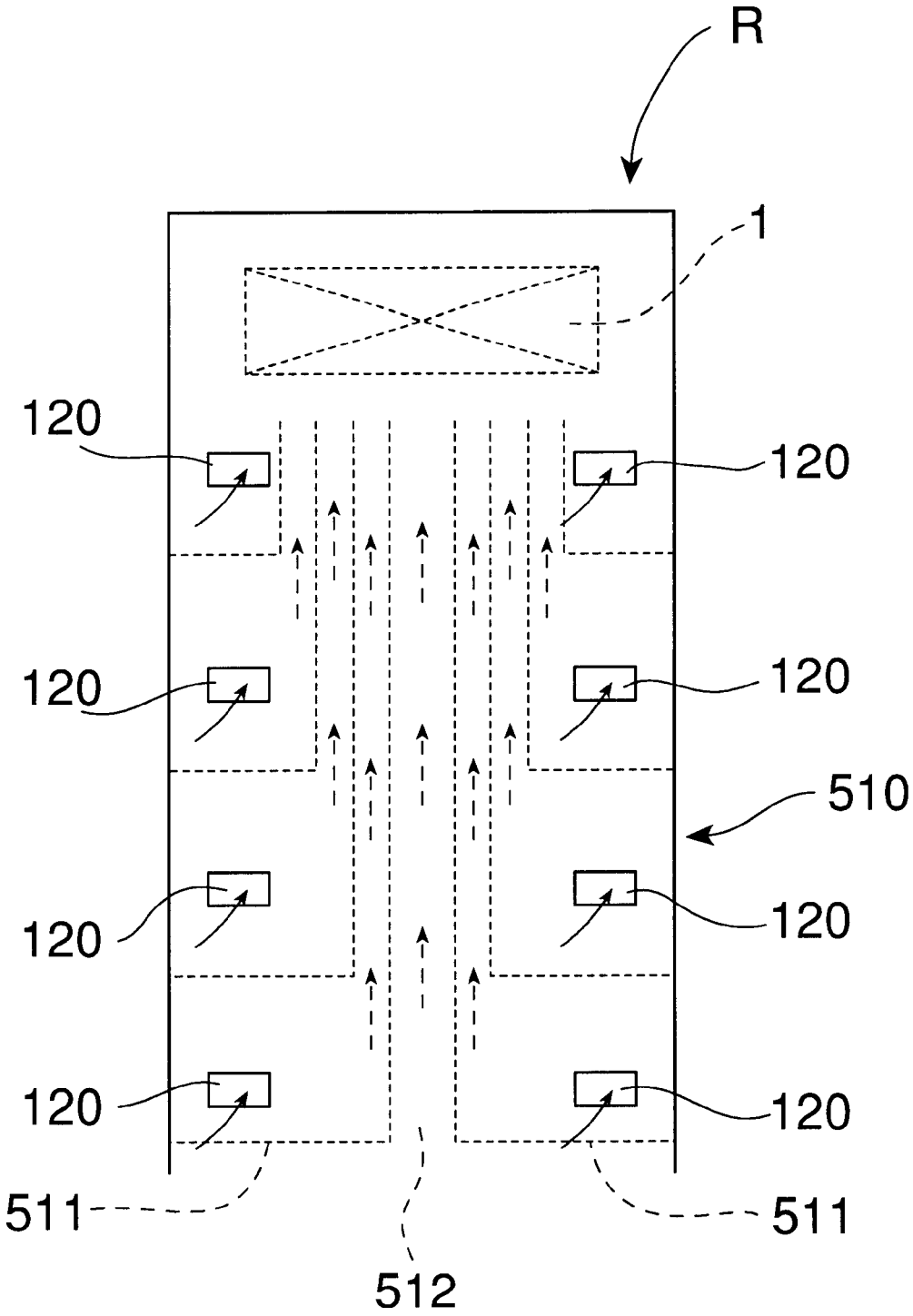
FIG. 9 is a rear view showing a variation of the second embodiment.

As a variation of this second embodiment, the interiors of the refrigerating compartment return ducts 511 and 511 are further subdivided for each chill return port 120 as shown in FIG. 9, whereby it becomes possible to delicately control the temperature of each storage portion within the refrigerating compartment 100. In this respect, in this second embodiment, the top surface duct 530 within the duct 500 does not have to be divided.

Figure 10:
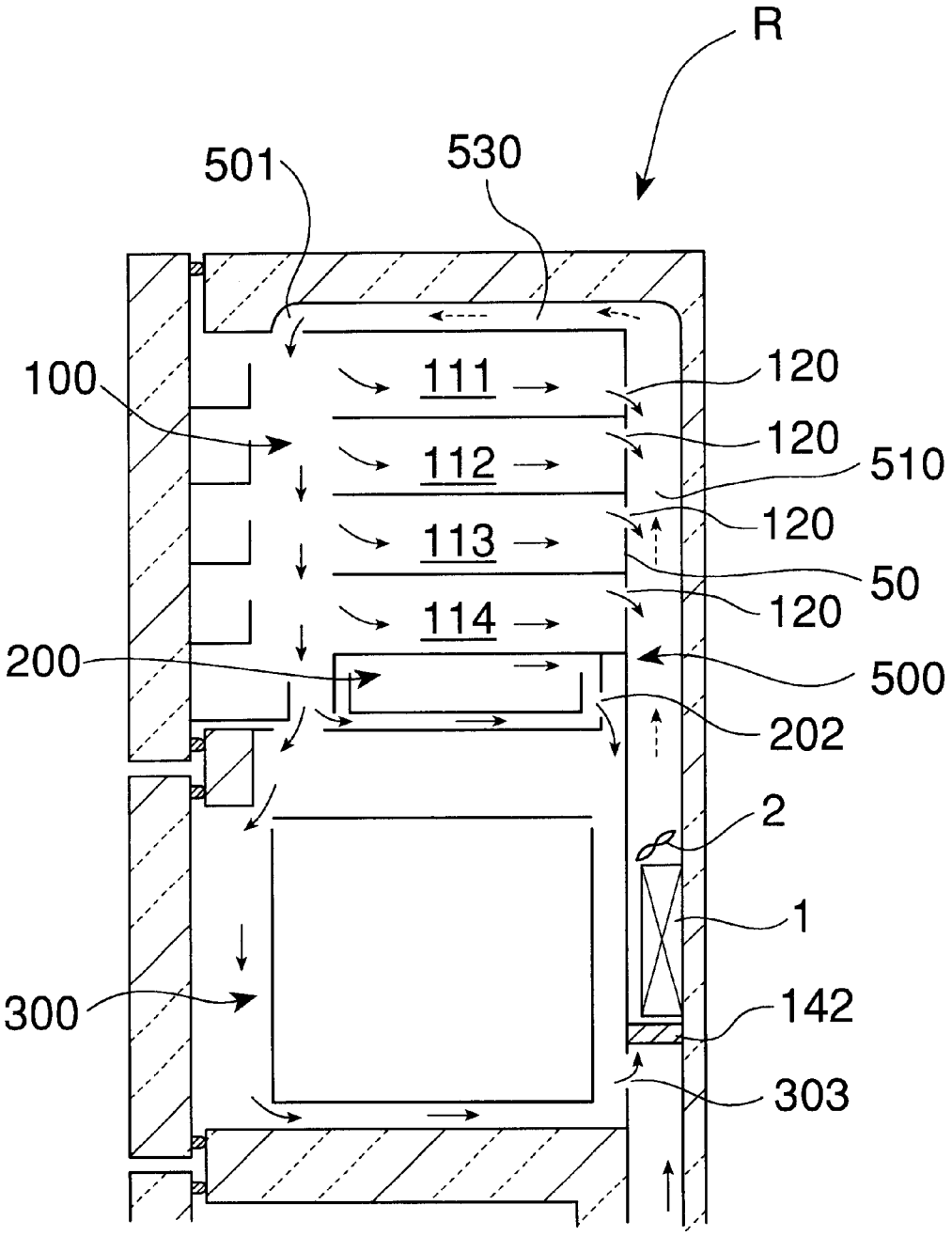
FIG. 10 is a sectional view schematically showing a third embodiment according to the present invention.

Next, the description will be made of the third embodiment of FIGS. 10 and 11. In this third embodiment, unlike the second embodiment, the heat exchanger 1 and the blower 2 are set up on the back surface side of, for example, the vegetable compartment 300 below the duct 500. For this reason, on both left and right sides of the storage portion 111 at the uppermost stage, there are formed chill return ports 120.

Figure 11:
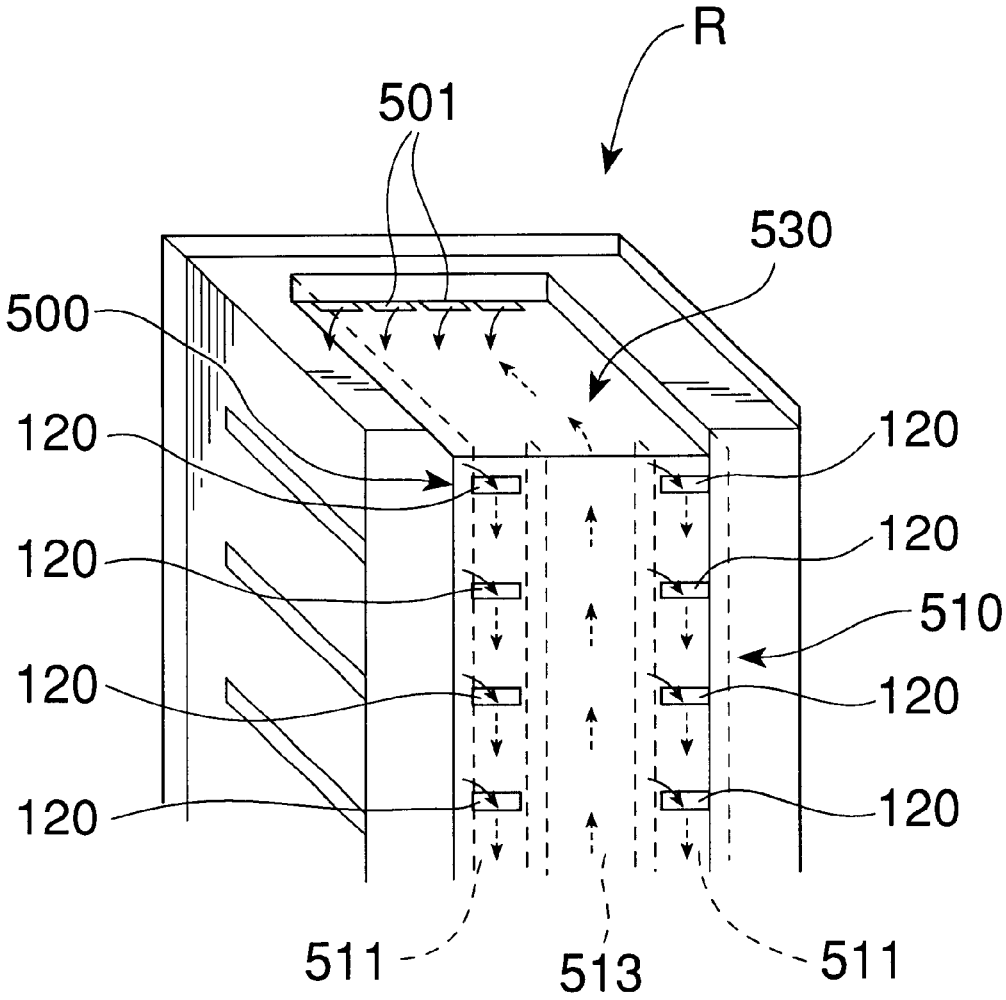
FIG. 11 is a perspective view showing the back surface side according to the third embodiment.

Even in this third embodiment, as shown in the back surface side perspective view of FIG. 11, on both left and right sides within the duct 510, there are provided refrigerating compartment return ducts 511 and 511, and in this case, each refrigerating compartment return duct 511, 511 extends downward to guide chills from each chill return port 120 to the suction side of the heat exchanger 1.

In this respect, chills from the chill return port 202 of the switchable compartment 200 once enter the vegetable compartment 300, and are directly returned to the suction side of the heat exchanger 1 from its chill return port 303 together with the chills of the vegetable compartment 300. Even in this third embodiment, on the suction side of the heat exchanger 1, there is provided the deodorant 142.

Figure 12:
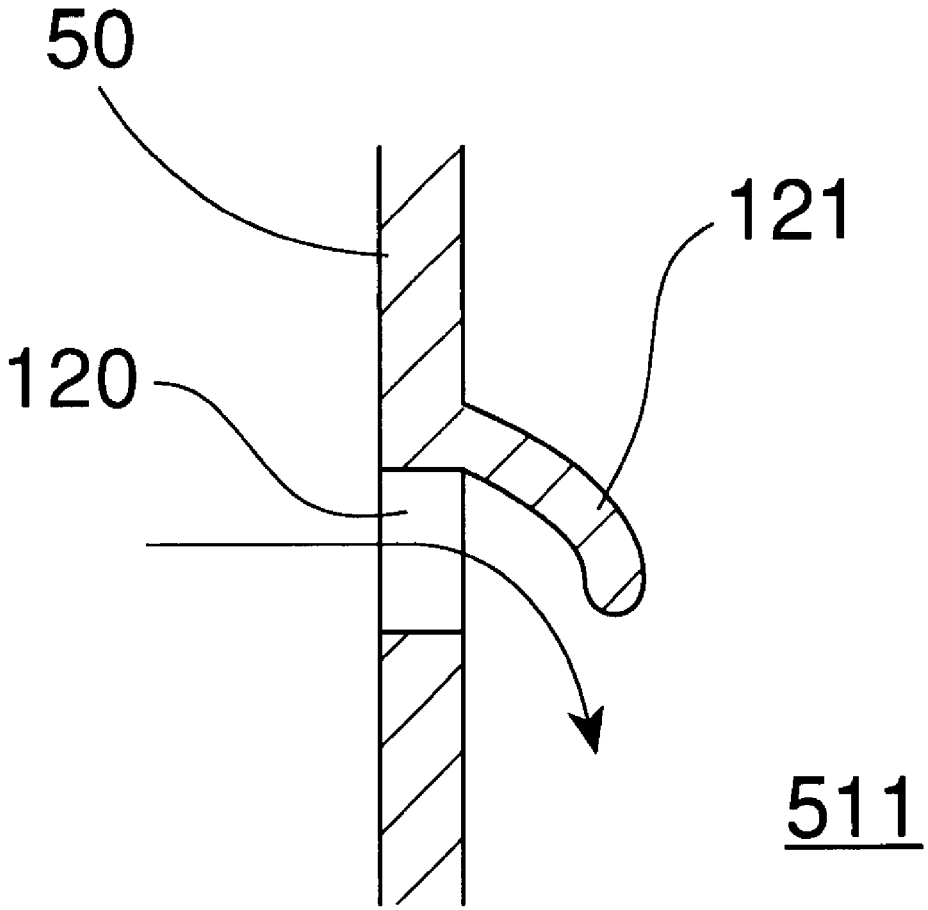
FIG. 12 is a partial enlarged sectional view showing the third embodiment.

In this third embodiment, between the refrigerating compartment return ducts 511, 511, there is formed a chill supply duct 513 for extending from the blower 2 to the top surface duct 530. According to this third embodiment, each chill return port 120 is attached with a hood 121 to turn in a downward direction as shown in FIG. 12.

Figure 13:
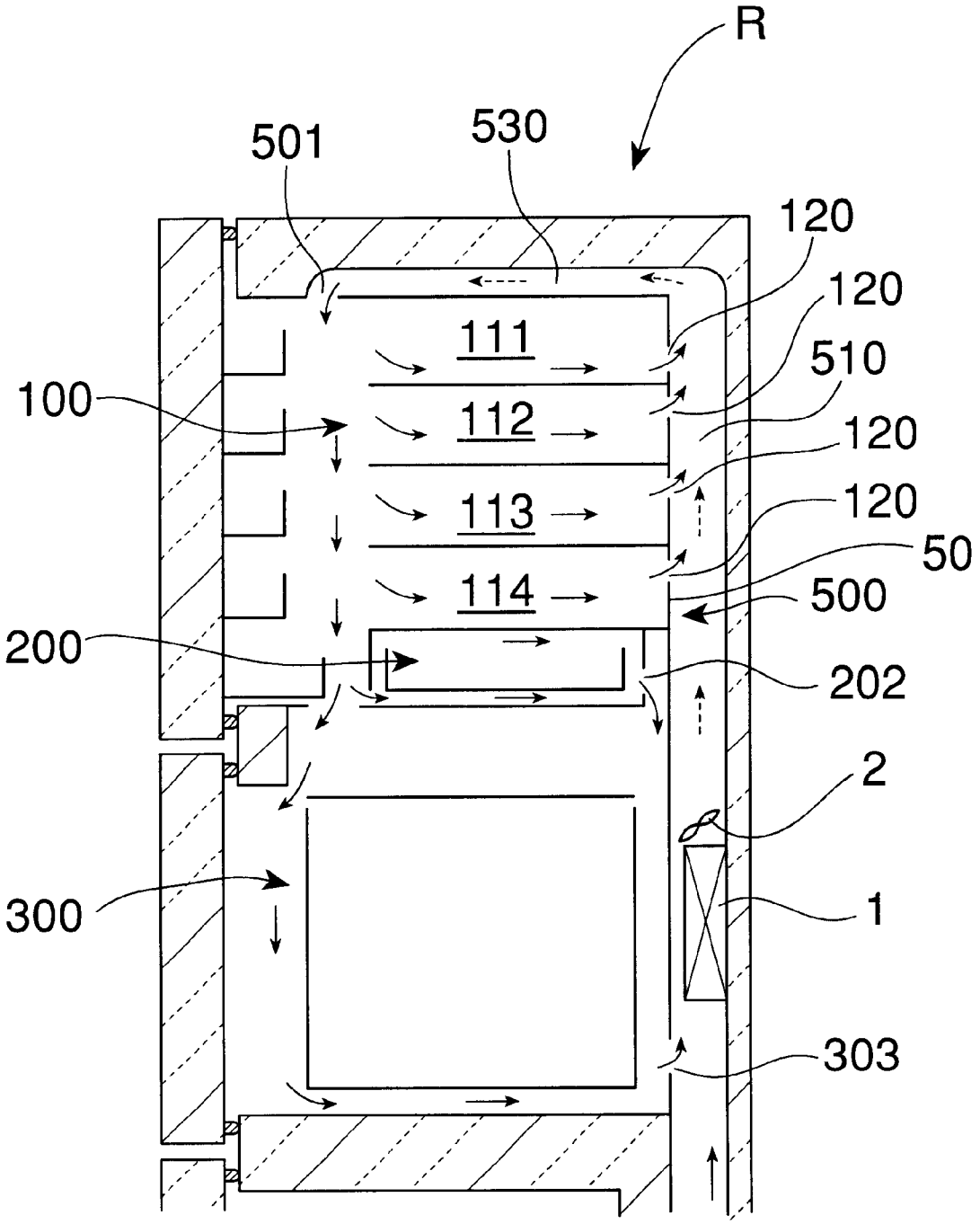
FIG. 13 is a sectional view schematically showing a fourth embodiment according to the present invention.
Figure 14:
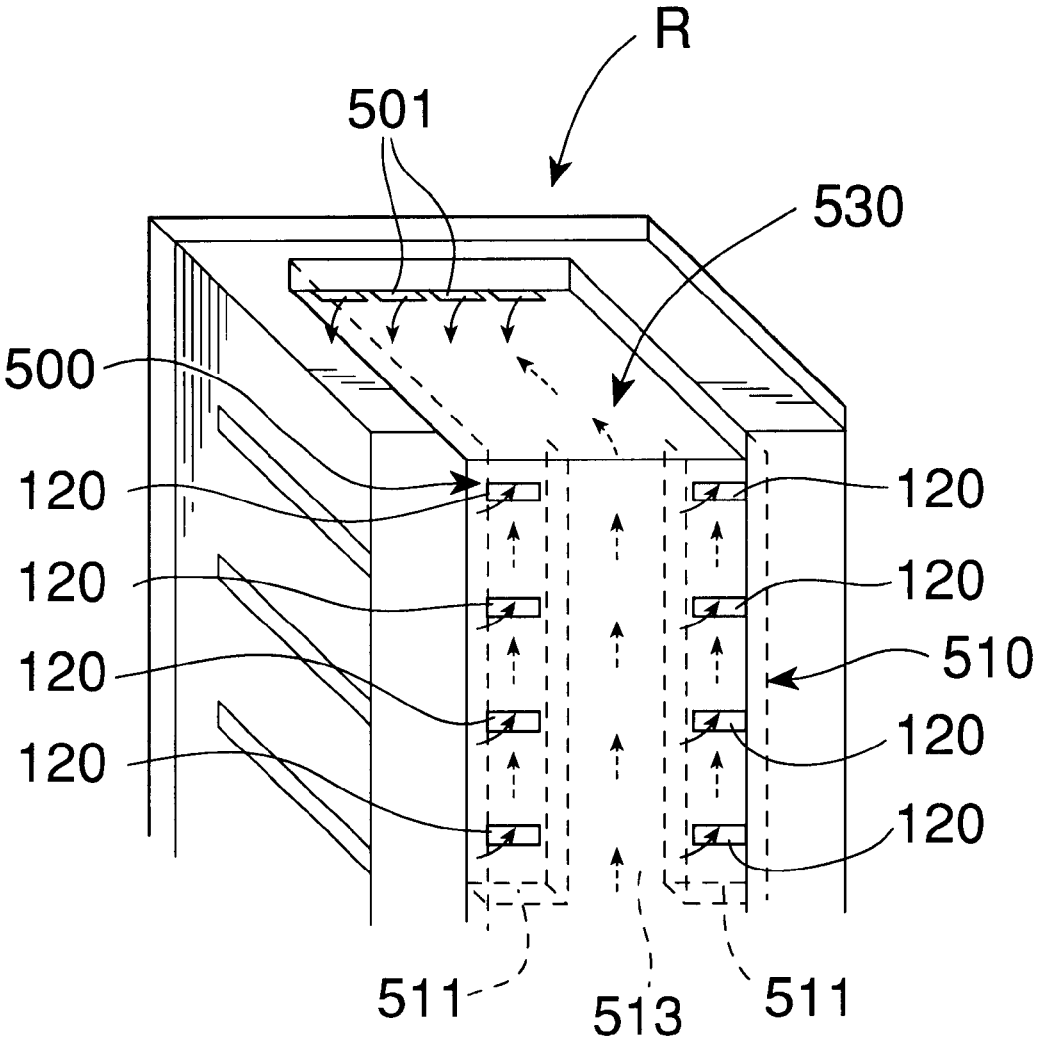
FIG. 14 is a perspective view showing the back surface side according to the fourth embodiment.

In the third embodiment, chills from each chill return port 120 are returned to the suction side of the heat exchanger 1 through each refrigerating compartment return duct 511, 511, but each refrigerating compartment return duct 511, 511 can be directed toward the top surface duct 530 together with the chill supply duct 513 as shown in the fourth embodiment of FIGS. 13 and 14 so as to circulate chills from each chill return port 120 within the refrigerating compartment 100. In this case, the major portion of the chills is to be returned to the suction side of the heat exchanger 1 through the vegetable compartment 300.

Figure 15:
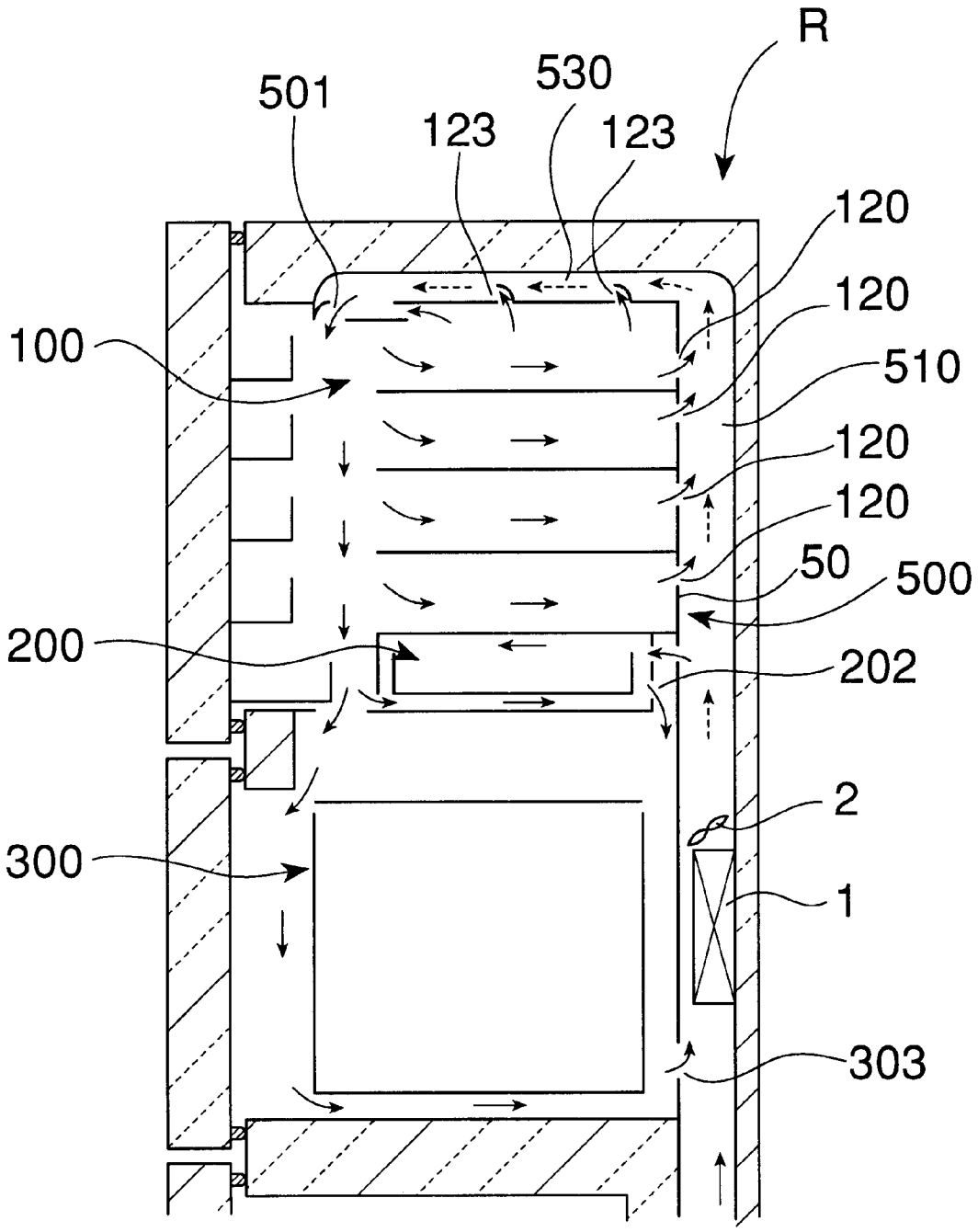
FIG. 15 is a sectional view schematically showing a fifth embodiment according to the present invention.
Figure 16:
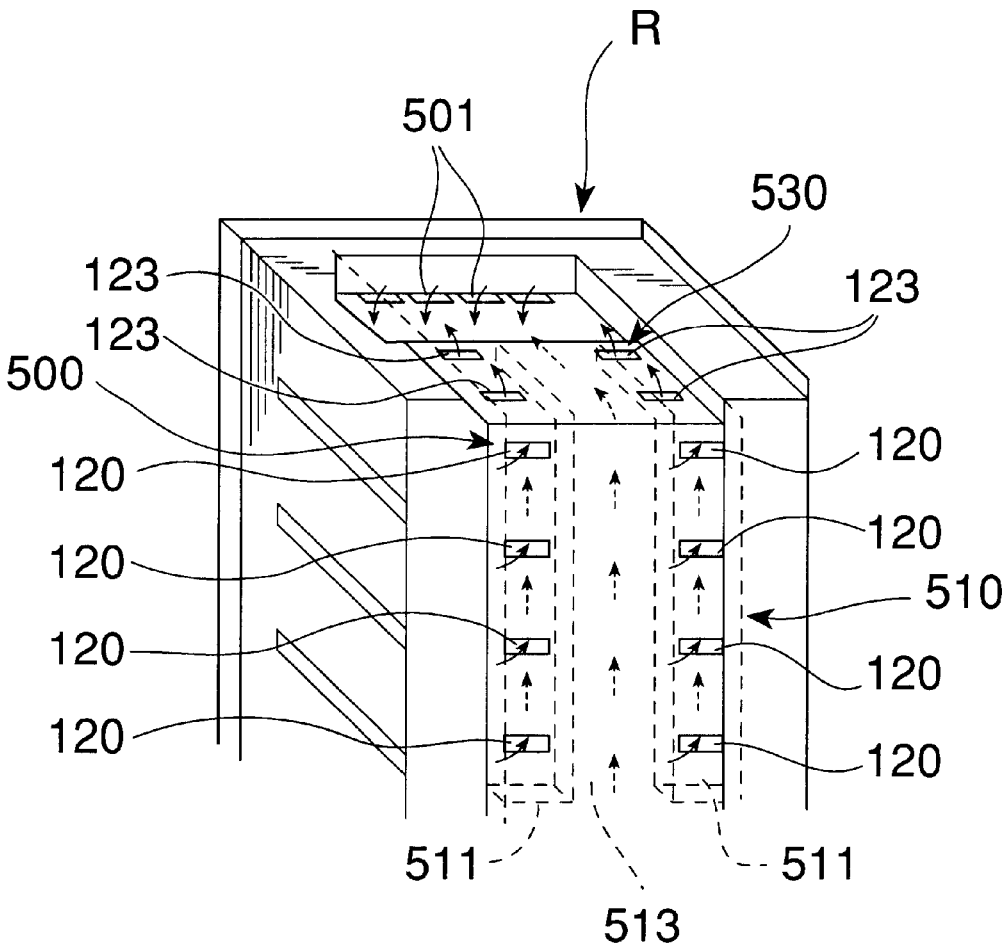
FIG. 16 is a perspective view showing the back surface side according to the fifth embodiment.

Next, with reference to FIGS. 15 and 16, the description will be made of the fifth embodiment. According to the fifth embodiment, in order to eliminate the temperature unevenness within the storage portion 111 at the uppermost stage, its upper wall (duct cover 20) is also provided with a top surface-side chill return port (third chill return port) 123 for communicating to the top surface duct 530.

These top surface-side chill return ports 123 are arranged on both left and right sides of the storage portion 111 at the uppermost stage in the same manner as in the back surface-side chill return port 120. Accordingly, in this fifth embodiment, each refrigerating compartment return duct 511, 511 is extended to the top surface duct 530 side to cover the top surface-side chill return port 123 as well.

Figure 17:
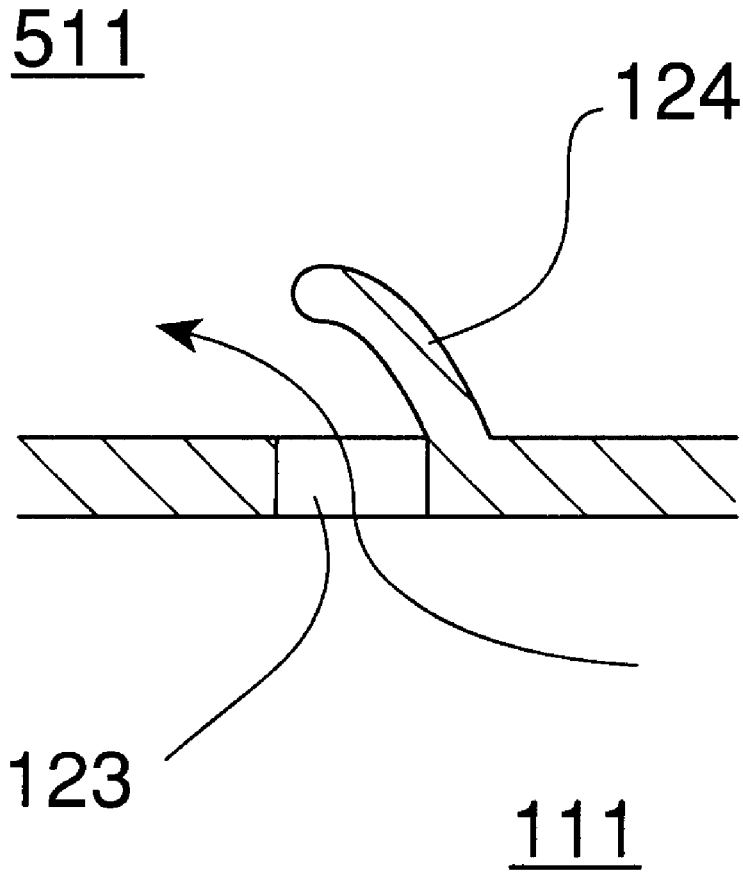
FIG. 17 is a partial enlarged sectional view showing the fifth embodiment.

In this fifth embodiment, return chills from the back surface-side chill return port 120 and the top surface-side chill return port 123 are conducted to the chill blow-off port 501 side together with the chill supply duct 513 through each refrigerating compartment return duct 511, 511 in the same manner as in the fourth embodiment. Even in this case, as shown in FIG. 17, the top surface-side chill return port 123 is preferably attached with a hood 124 for directing a return chill to the chill blow-off port 501 side.

Figure 18:
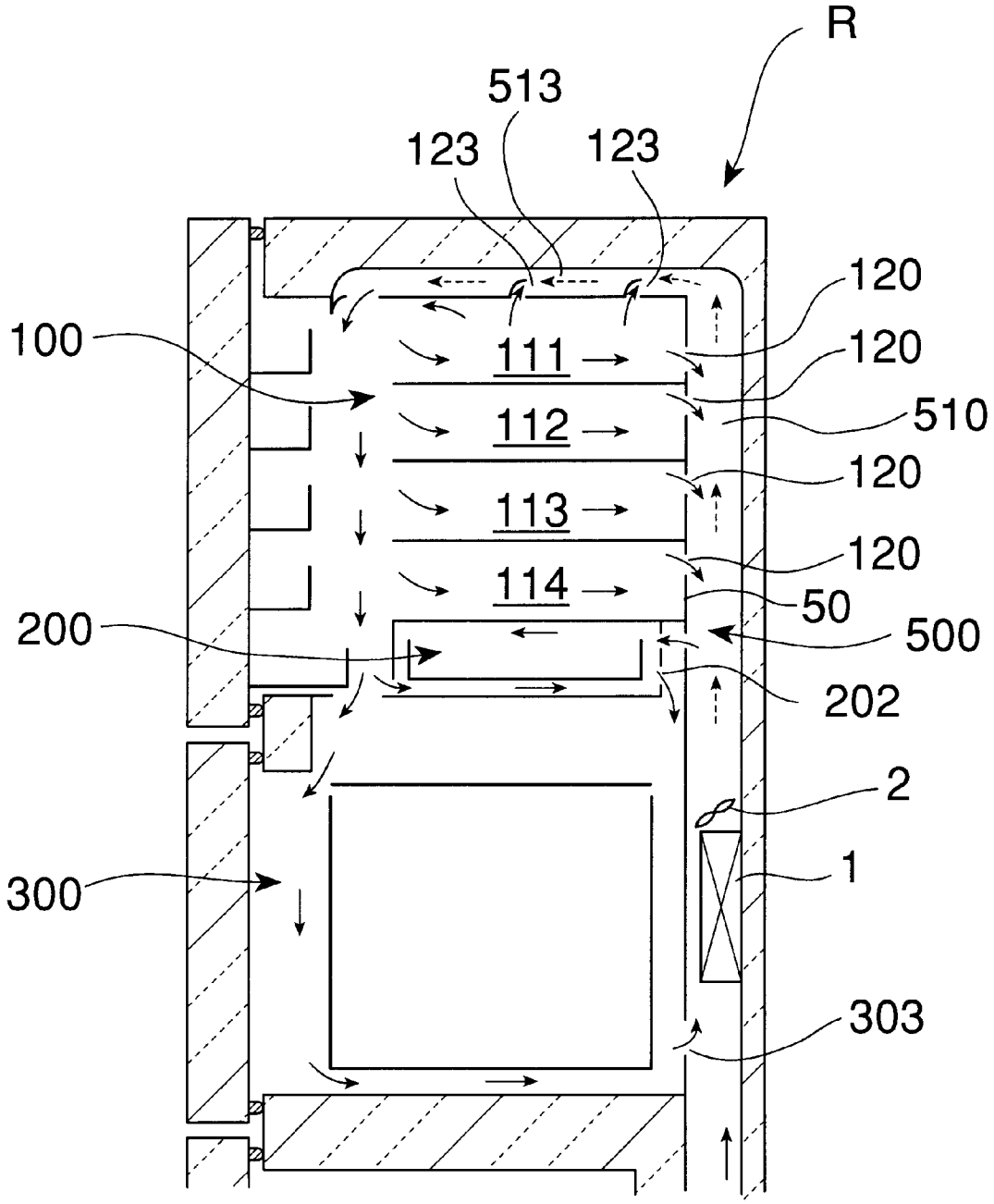
FIG. 18 is a sectional view schematically showing a sixth embodiment according to the present invention.
Figure 19:
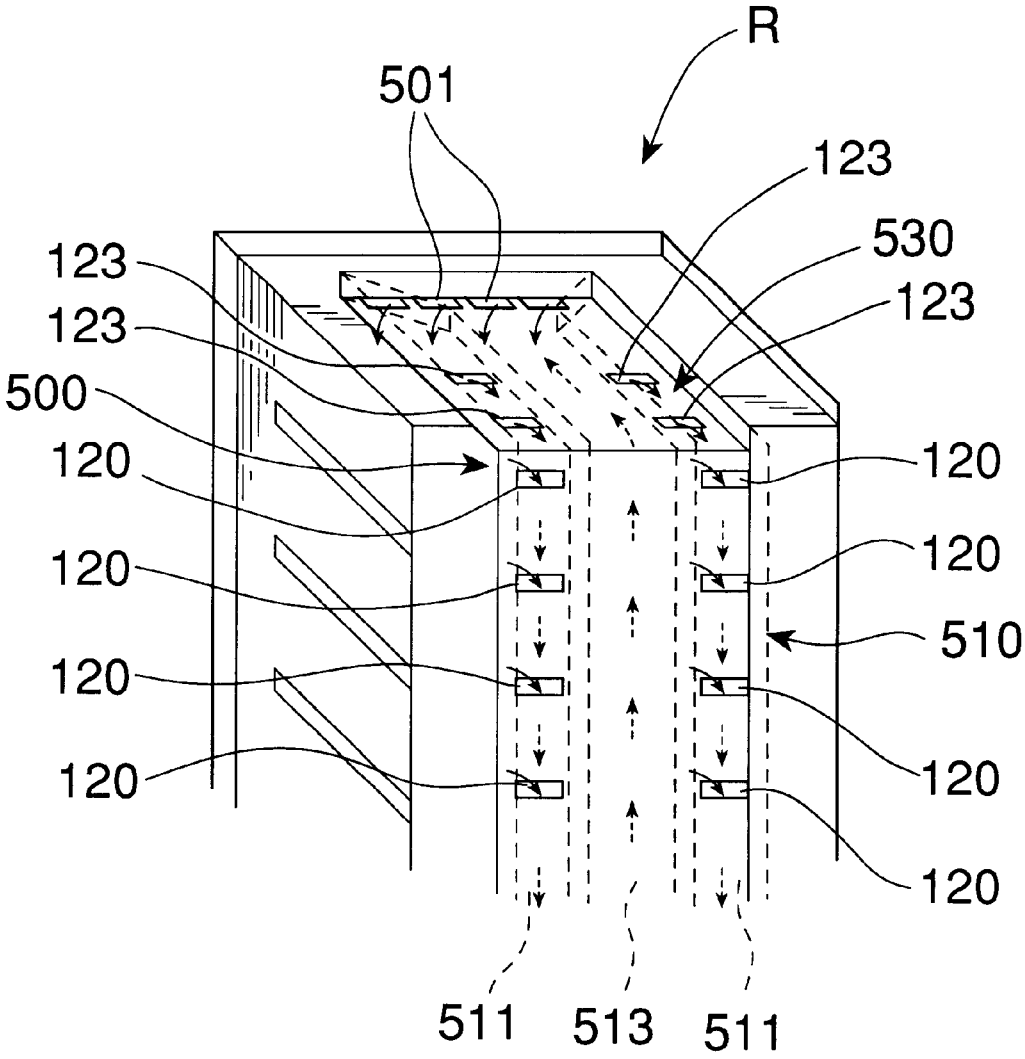
FIG. 19 is a perspective view showing the back surface side according to the sixth embodiment.
Figure 20:
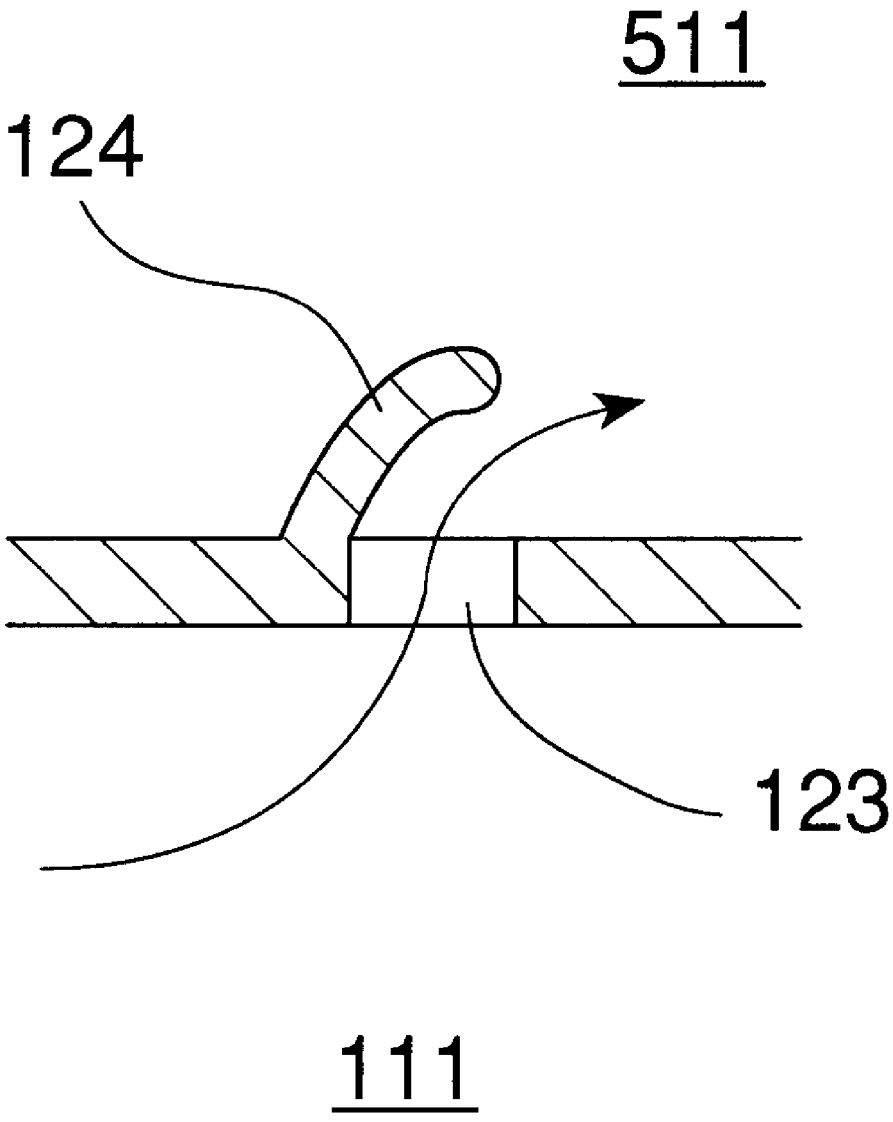
FIG. 20 is a partial enlarged sectional view showing the sixth embodiment.

Contrary to the fifth embodiment, a return chill from the back surface-side chill return port 120 and the top surface-side chill return port 123 can be arranged to be conducted to the suction side of the heat exchanger 1 provided below through each refrigerating compartment return duct 511, 511 as shown in the sixth embodiment of FIGS. 18 and 19. In this case, the direction of the hood 124 is made opposite to that of the fifth embodiment as shown in FIG. 20. The chill supply duct 513 extends from the blower 2 side to the chill blow-off port 501 in a series.

Figure 21:
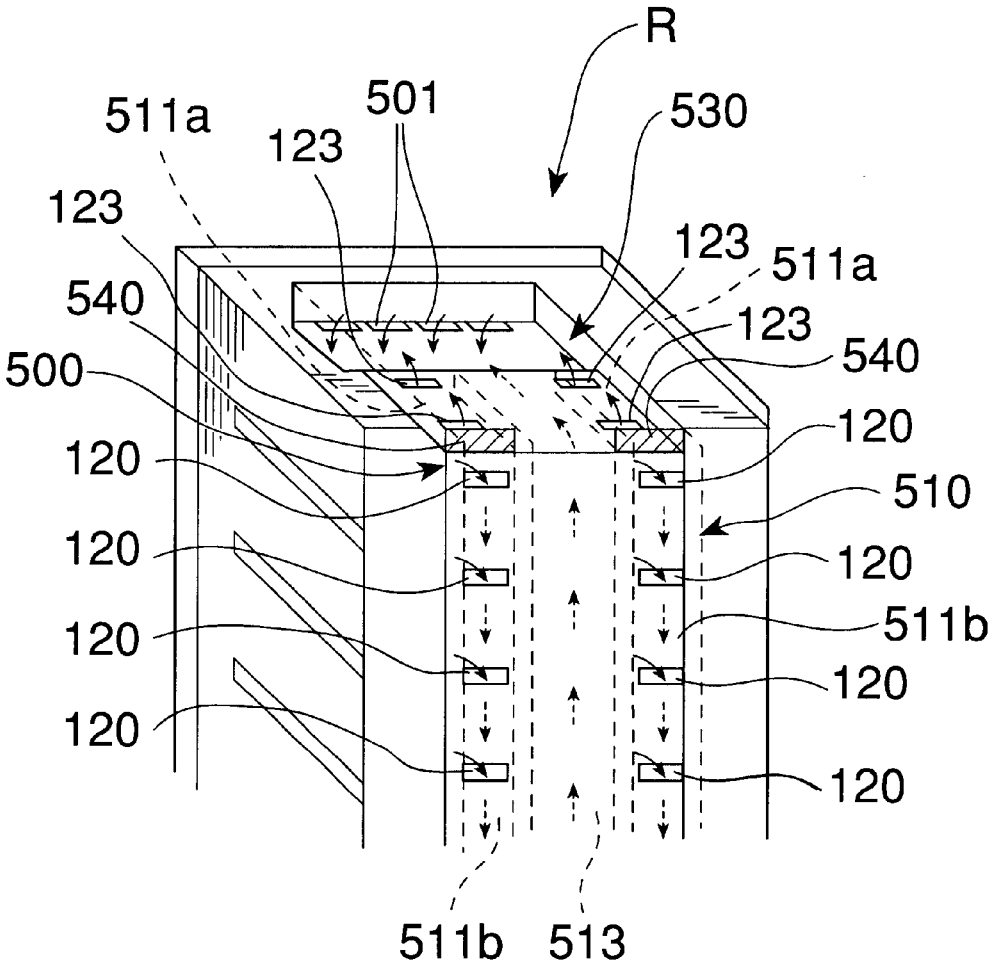
FIG. 21 is a perspective view for the back surface side schematically showing the seventh embodiment according to the present invention.

The seventh embodiment shown in FIG. 21 is eclectic between the fifth embodiment and the sixth embodiment. That is, in a boundary portion between the top surface side and the back surface side of each refrigerating compartment return duct 511, there is provided a shielding plate 540, each refrigerating compartment return duct 511 is divided into a top surface-side refrigerating compartment return duct 511*a* and a back surface-side refrigerating compartment return duct 511*b*, and are turn chill from the top surface-side chill return port 123 is conducted to the chill blow-off port 501 side through the top surface-side refrigerating compartment return duct 511*a* while a return chill from the back surface-side chill return port 120 is conducted to the suction side of the heat exchanger 1.

Figure 22:
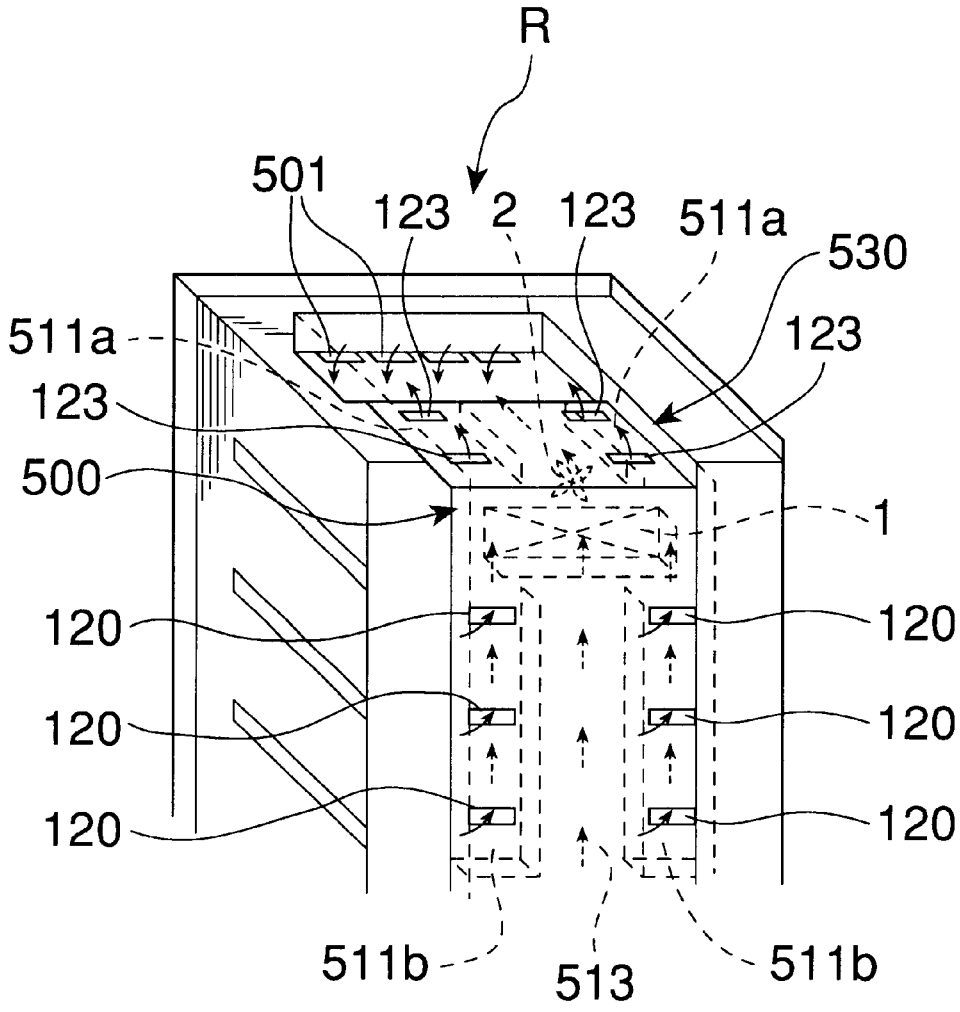
FIG. 22 is a perspective view for the back surface side schematically showing the eighth embodiment according to the present invention.

The fifth to seventh embodiments show an example in which the storage portion 111 at the uppermost stage has been formed with the top surface-side chill return port 123 when the heat exchanger 1 and the blower 2 are arranged on the back surface side of, for example, the vegetable compartment 300 in the lower part of the back surface duct 510. FIG. 22 shows an eighth embodiment in which the storage portion 111 at the uppermost stage has been formed with the top surface-side chill return port 123 when the heat exchanger 1 and the blower 2 are arranged in the upper part of the back surface duct 510, that is, in the upper part on the back surface side of the refrigerating compartment 100.

In the eighth embodiment, the top surface-side refrigerating compartment return duct 511*a* and the back surface-side refrigerating compartment return duct 511*b* have been individually formed respectively, in such a manner that in the back surface-side refrigerating compartment return duct 511*b*, the return chill from the back surface-side chill return port 120 is conducted on the suction side of the heat exchanger 1 while in the top surface-side refrigerating compartment return duct 511*a*, the return chill from the top-surface side chill return port 123 is conducted toward an air blow-off port 501 side.

Figure 23:
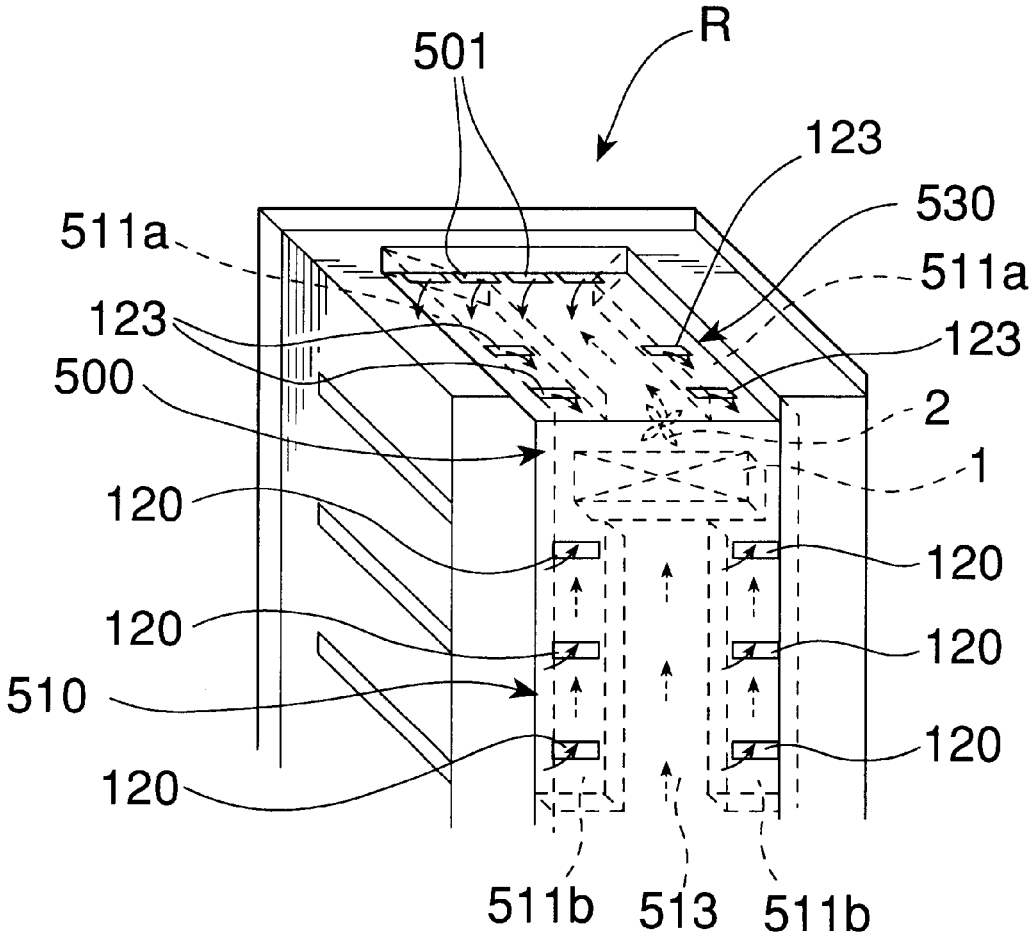
FIG. 23 is a perspective view for the back surface side schematically showing a variation of the eighth embodiment.

In this respect, the eighth embodiment can be transformed as shown in FIG. 23. More specifically, it may be possible to direct the top surface-side refrigerating compartment return duct 511*a* toward the heat exchanger 1 side for conducting both the return chill from the top surface-side chill return port 123 and the return chill from the back surface-side chill return port 120 to the suction side of the heat exchanger 1.

Figure 24:
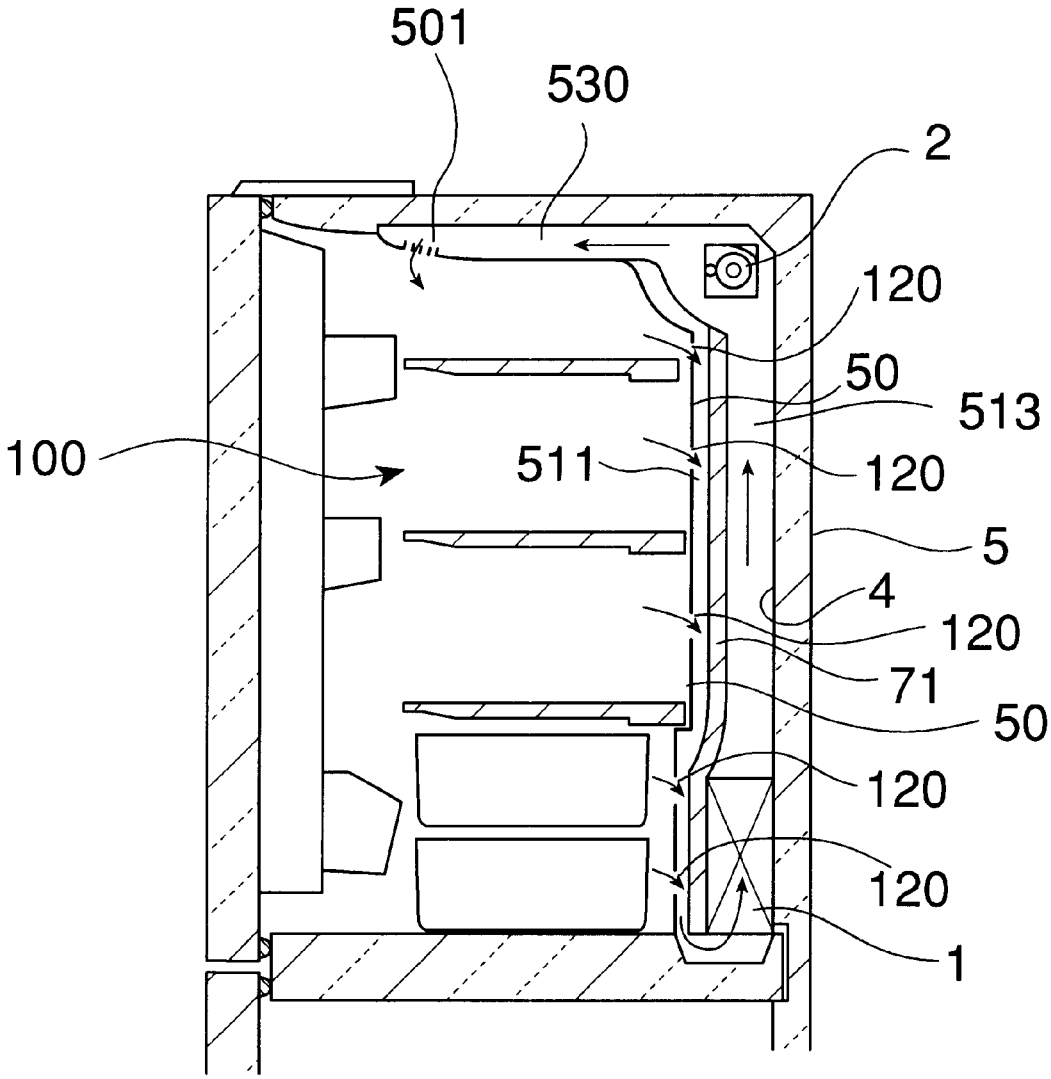
FIG. 24 is a sectional view schematically showing a ninth embodiment according to the present invention.

In each of the above-described embodiments, the interior of the duct 500 has been divided into there frigerating compartment return duct 511 and the vegetable compartment return duct 512 in the lateral direction, or into the refrigerating compartment return duct 511 and a chill supply duct 513, but as shown in the ninth embodiment of FIG. 24, it is also possible to divide the back surface duct 510 within the duct 500 in a back-and-forth direction as viewed from the inside of the compartment by means of a thermal insulating plate 71, to form the refrigerating compartment return duct 511 between a duct cover 50 and the thermal insulating plate 71, and to form the chill supply duct 513 communicating to the top surface duct 530 between the thermal insulating plate 71 and the inner case 4, and such an aspect is also included in the present invention.

Next, referring to FIGS. 25A and 25B and subsequent figures, the description will be made of other embodiments according to the present invention, detail of each portion or variations. Elements identical or regarded as identical to those in the first embodiment are designated by the identical reference numerals. Also, FIG. 25A and subsequent figures are schematic figures showing only essential portions, and illustration of the freezer compartment is omitted.

Figure 25A:
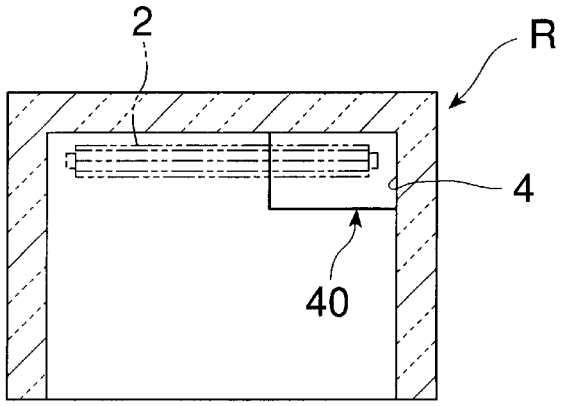
FIG. 25A is a top perspective view schematically showing a tenth embodiment according to the present invention.
Figure 25B:
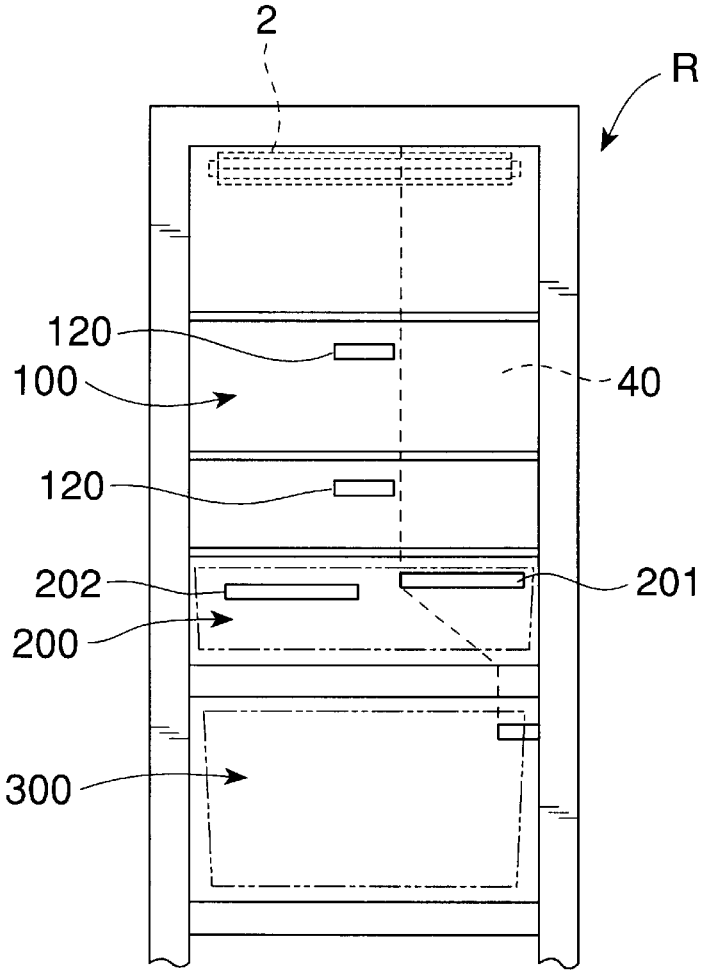
FIG. 25B is a front view when its interior is viewed from the door side.

FIG. 25A is a top plan view showing the main body R of the refrigerator according to a tenth embodiment, and FIG. 25B is a front view showing the interior of the compartments. In the tenth embodiment, a dedicated duct 40 for the vegetable compartment 300 and the switchable compartment 200 is used as a mixing duct in common, and is arranged in a corner of the back surface within the compartment. In this case, two L-character-shaped surfaces will suffice for the duct cover for the dedicated duct 40, and for the remaining two surfaces, the inner case 4 can be utilized.

Figure 26A:
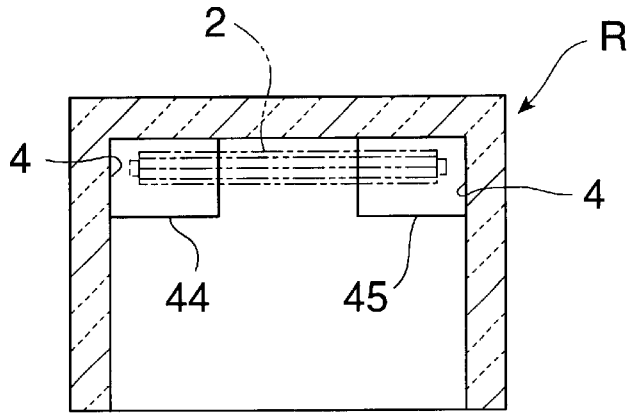
FIG. 26A is a top perspective view schematically showing an eleventh embodiment according to the present invention.
Figure 26B:
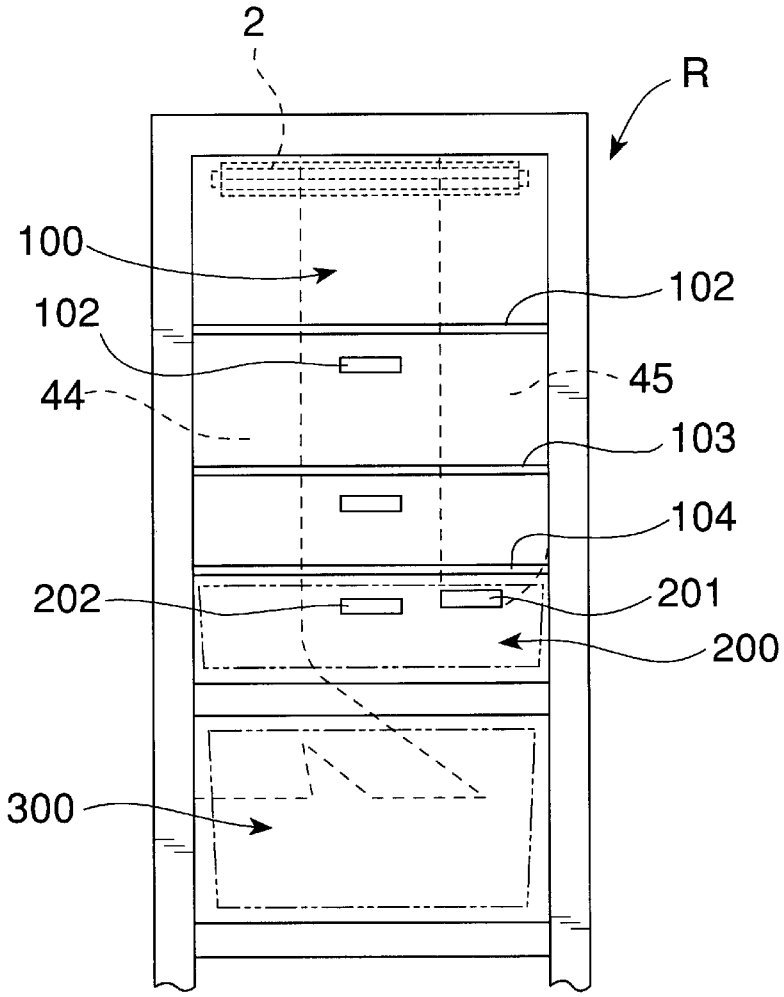
FIG. 26B is a front view when its interior is viewed from the door side.

FIG. 26A is a top plan view showing the main body R of the refrigerator according to an eleventh embodiment, and FIG. 26B is a front view showing the interior of the compartment. This eleventh embodiment belongs to variations of the tenth embodiment, and the dedicated duct for the vegetable compartment 300 is provided discretely from the dedicated duct for the switchable compartment 200, and the dedicated duct 44 for the vegetable compartment 300 is arranged in a corner of the back surface, for example, on the left side within the compartment while the dedicated duct 45 for the switchable compartment 200 is arranged in a corner of the back surface on the right side within the compartment. Also, since the dedicated duct 44 for the vegetable compartment 300 disperses the chill for emitting, the dedicated duct 44 is divided to both ways within the vegetable compartment 300.

Figure 27:
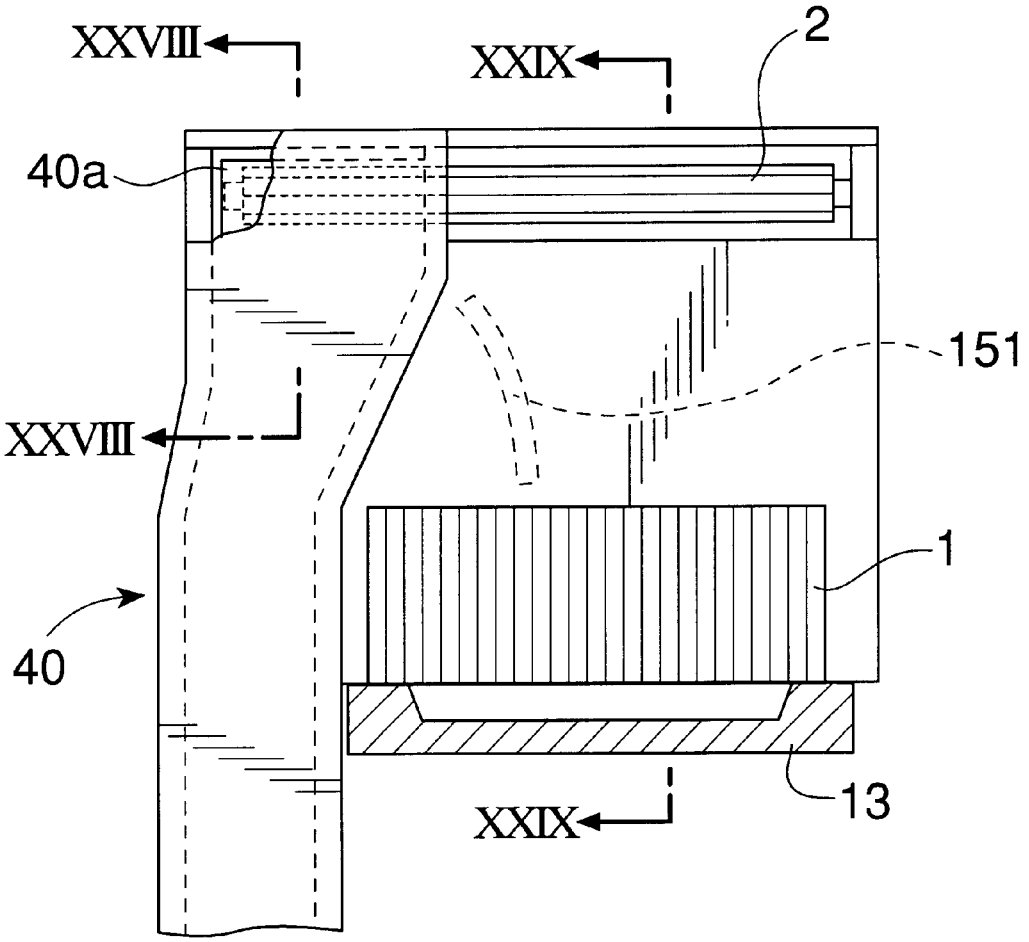
FIG. 27 is a front view schematically showing essential portions of a twelfth embodiment according to the present invention.
Figure 28:
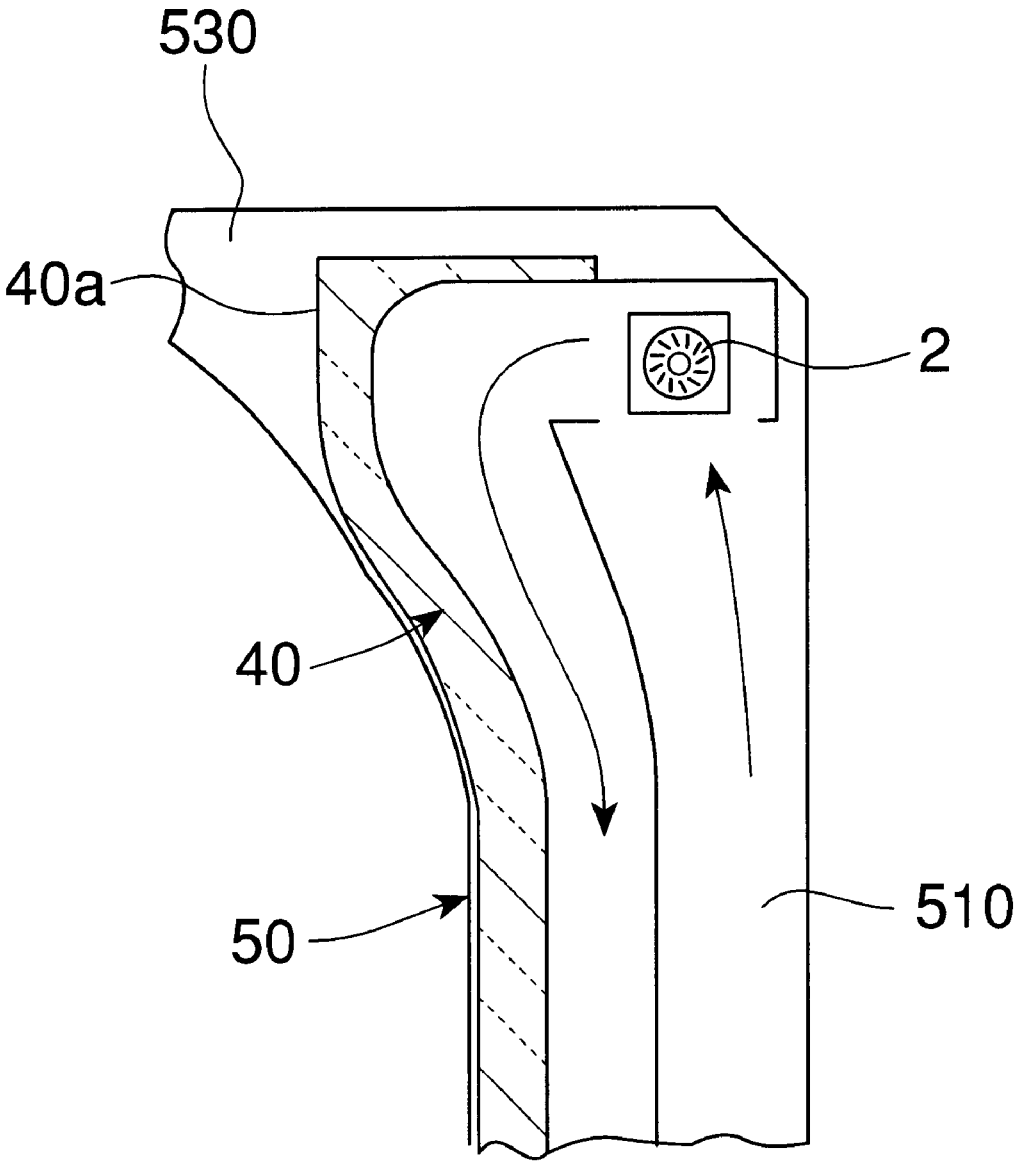
FIG. 28 is a sectional view taken on line XXVIII—XXVIII of FIG. 27.
Figure 29:
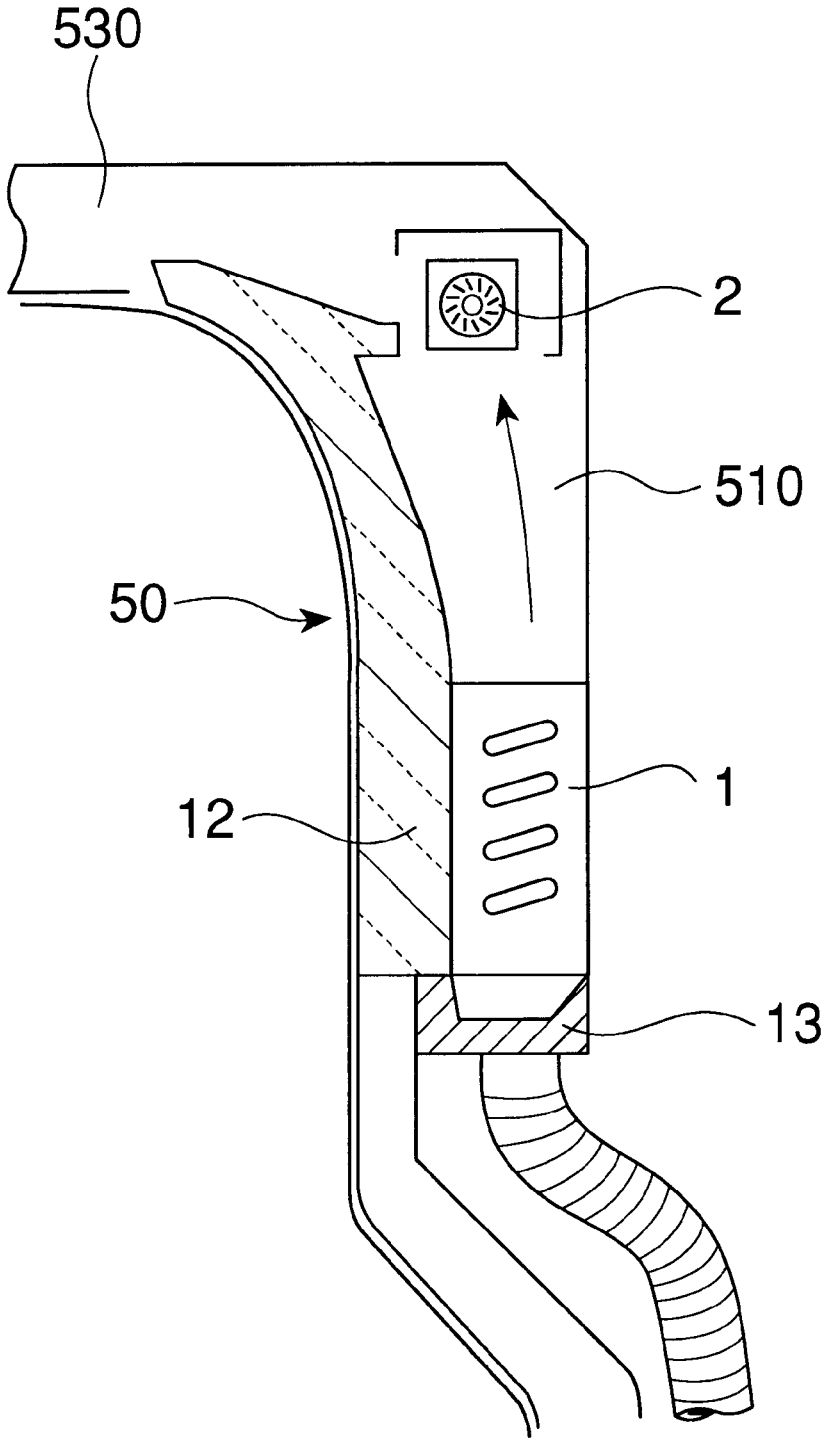
FIG. 29 is a sectional view taken on line XXIX—XXIX of FIG. 27.
Figure 30:
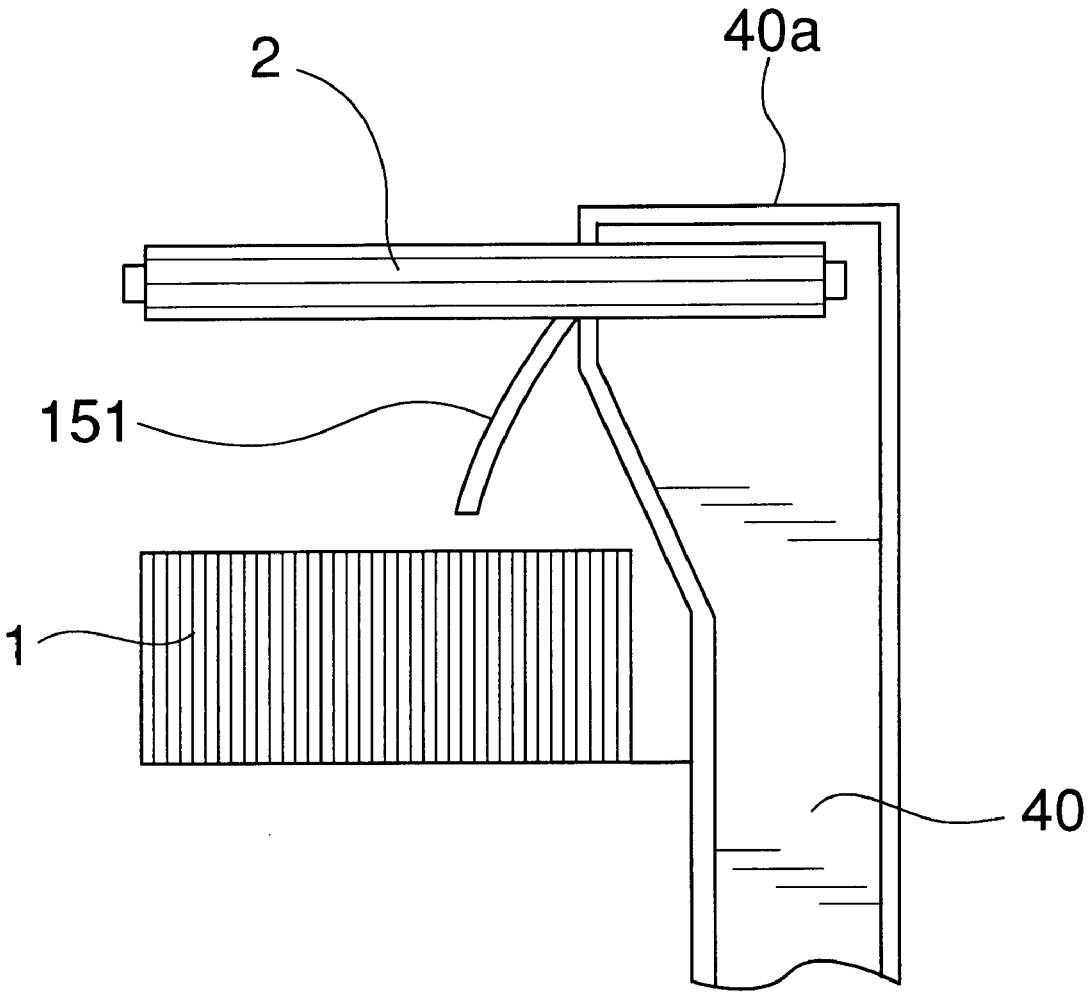
FIG. 30 is a rear view schematically showing essential portions of the twelfth embodiment.
Figure 31:
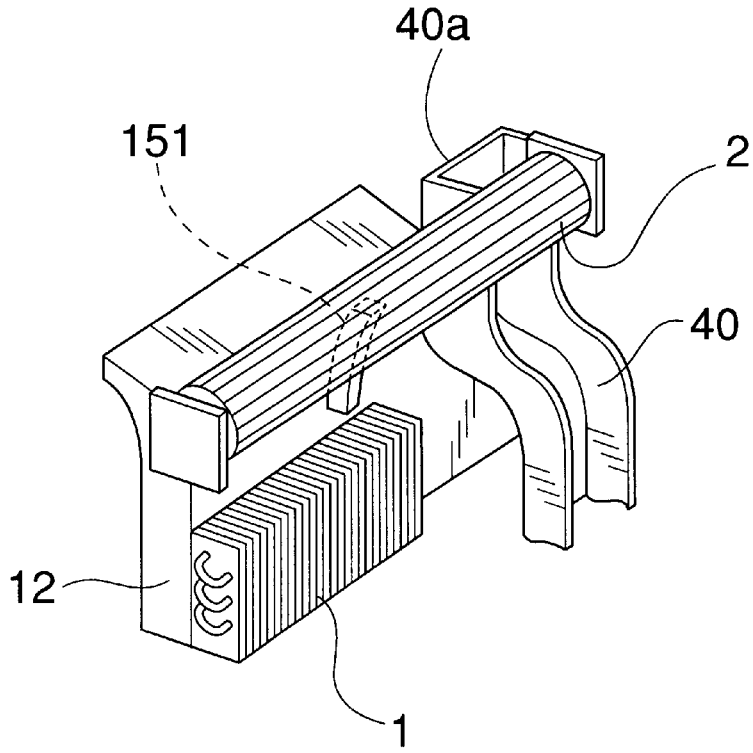
FIG. 31 is a rear perspective view schematically showing essential portions of the twelfth embodiment.
Figure 32:
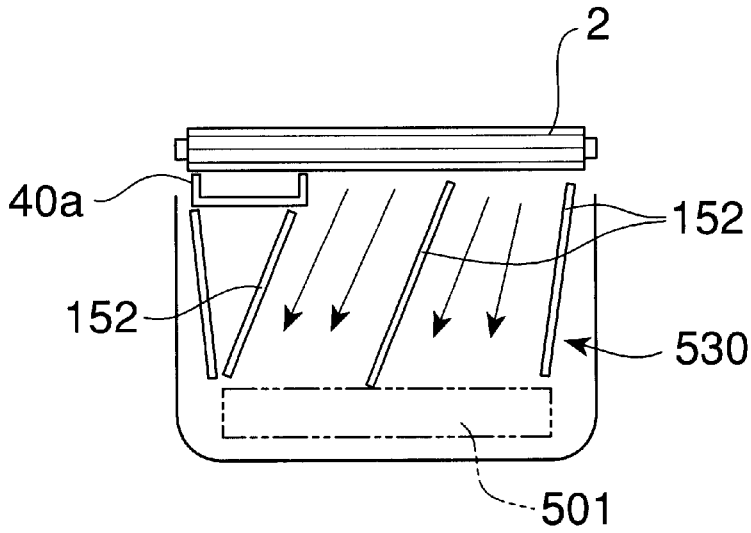
FIG. 32 is a top perspective view schematically showing essential portions of the twelfth embodiment.

With reference to FIGS. 27 to 32, the description will be made of the twelfth embodiment. In this respect, FIG. 27 is a front view showing essential portions including the heat exchanger 1 and the blower 2 as viewed from the inside of the compartment; FIGS. 28 and 29 are sectional views taken on line XXVIII—XXVIII and line XXIX—XXIX of FIG. 27 respectively; FIG. 30 is a rear view of FIG. 27; FIG. 31 is its rear surface perspective view; and FIG. 32 is a top plan view showing the top surface duct 530.

For the blower 2, a cross flow fan is used, and according to this twelfth embodiment, as shown in, for example, FIGS. 27 and 32, on one end side of the air supply port of the cross flow fan 2, there is arranged a chill introducing unit 40*a* for the dedicated duct 40, and the chill is supplied to the top surface duct 530 from the rest of the air supply port.

The dedicated duct 40 is formed on the back surface side of the duct cover 50 using thermal insulating material, and is conducted to the vegetable compartment 300 and/or the switchable compartment 200 along the side of the heat exchanger 1. The dedicated duct 40 is arranged at a side position of the heat exchanger 1 as described above, whereby the dedicated duct 40 can be provided without reducing the internal volume of the compartment, and its duct area can be also taken large.

Also, as shown in FIGS. 31 and 32, between the heat exchanger 1 and the suction port of the cross flow fan 2, there is provided a chill guide plate 151 for conducting a part of a chill generated by the heat exchanger 1 to one end side (side where there is the chill introducing unit 40*a* of the dedicated duct 40) of the cross flow fan 2. Thereby, the chill generated by the heat exchanger 1 is not blown to one side on the top surface duct 530 side, but efficient chill circulation can be achieved.

Also, since the dedicated duct 40 is arranged on one end side of the cross flow fan 2 as shown in FIG. 32, a blast aperture width of the remainder of the air supply port of the cross flow fan 2 becomes narrower than the chill blow-off port 501, which may possibly cause irregularity of the amount of blown-off chill from the chill blow-off port 501. Thus, in this twelfth embodiment, in order to make the chill to be blown from the cross flow fan 2 uniform toward the full width of the chill blow-off port 501, there is also provided a chill guide plate 152 within the top surface duct 530.

Figure 33:
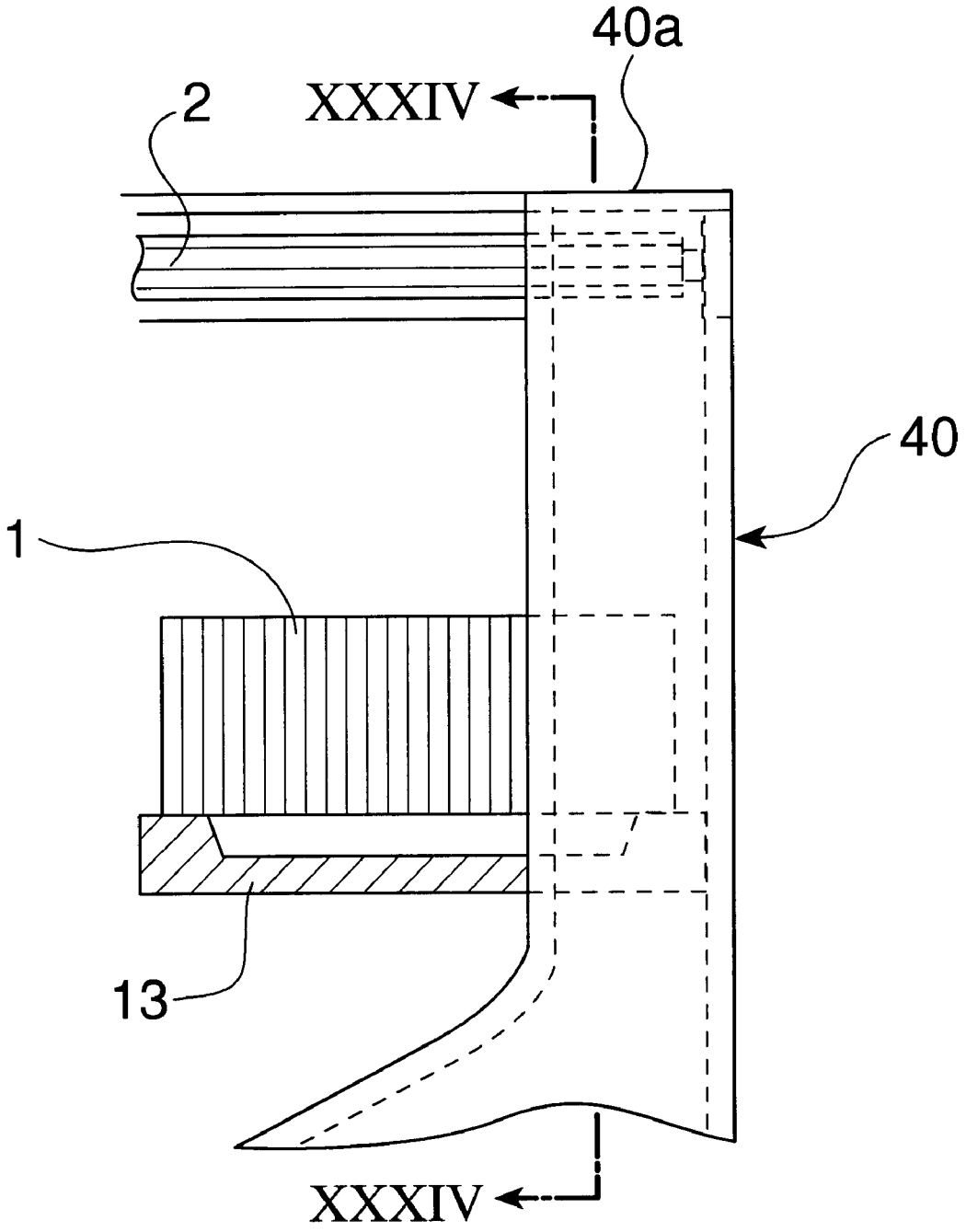
FIG. 33 is a front view schematically showing essential portions of a thirteenth embodiment according to the present invention.
Figure 34:
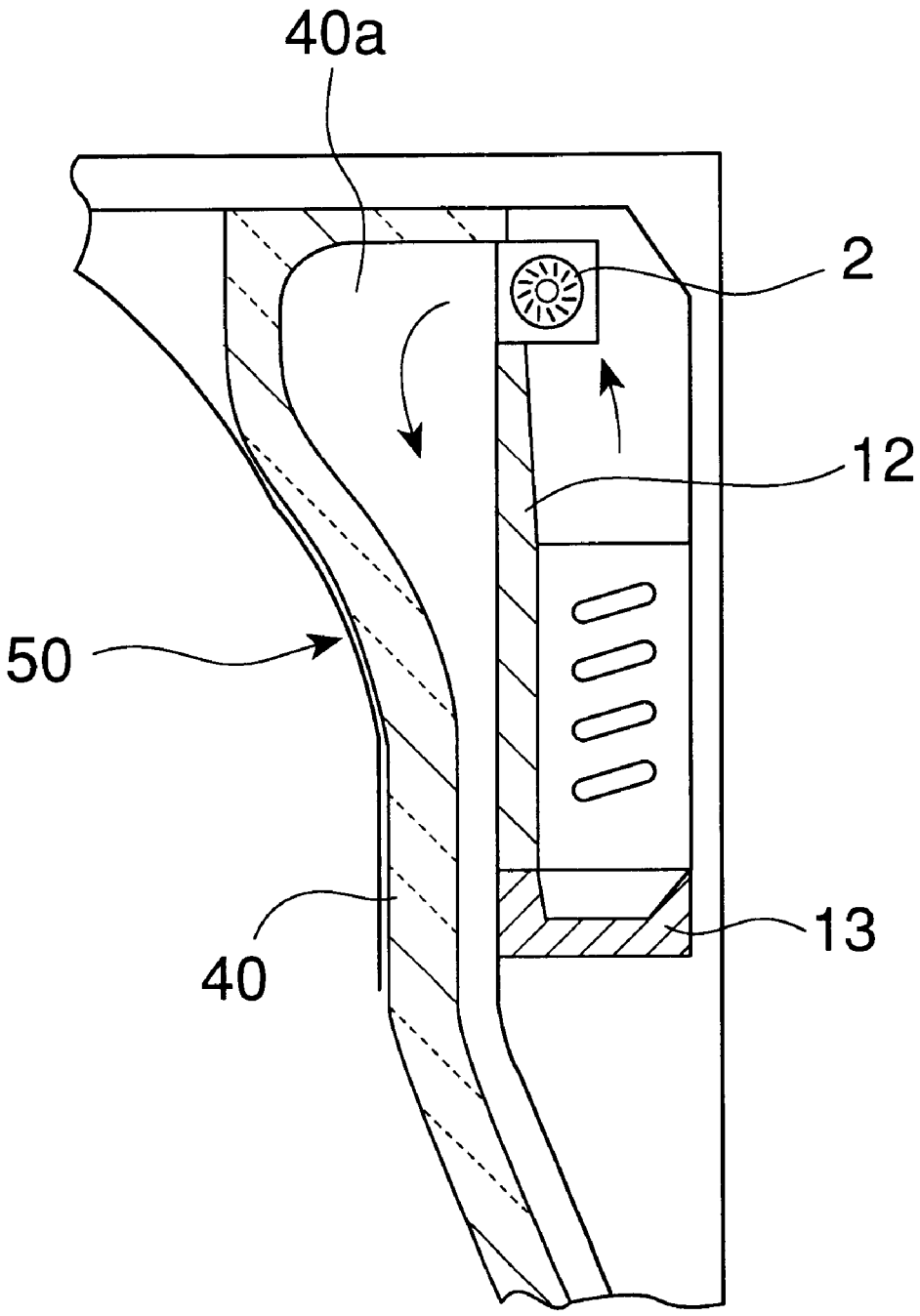
FIG. 34 is a sectional view taken on line XXXIV—XXXIV of FIG. 33.

In the twelfth embodiment, the dedicated duct 40 has been arranged so as to pass along the side of the heat exchanger 1, but in the thirteenth embodiment, the dedicated duct 40 has been arranged so as to pass in front of the heat exchanger 1 as shown in the essential front view of FIG. 33 and FIG. 34, its sectional view taken on line XXXIV—XXXIV.

In this case, between the dedicated duct 40 and the heat exchanger 1, there is provided thermal insulating material 12, and its thickness is made as thin as, for example, about 8 mm, whereby heat of the heat exchanger 1 is transmitted to within the dedicated duct 40 to be able to further reduce the temperature of the chill, which passes through the duct. Also, the capacity of the heat exchanger 1 will not be reduced.

Figure 35:
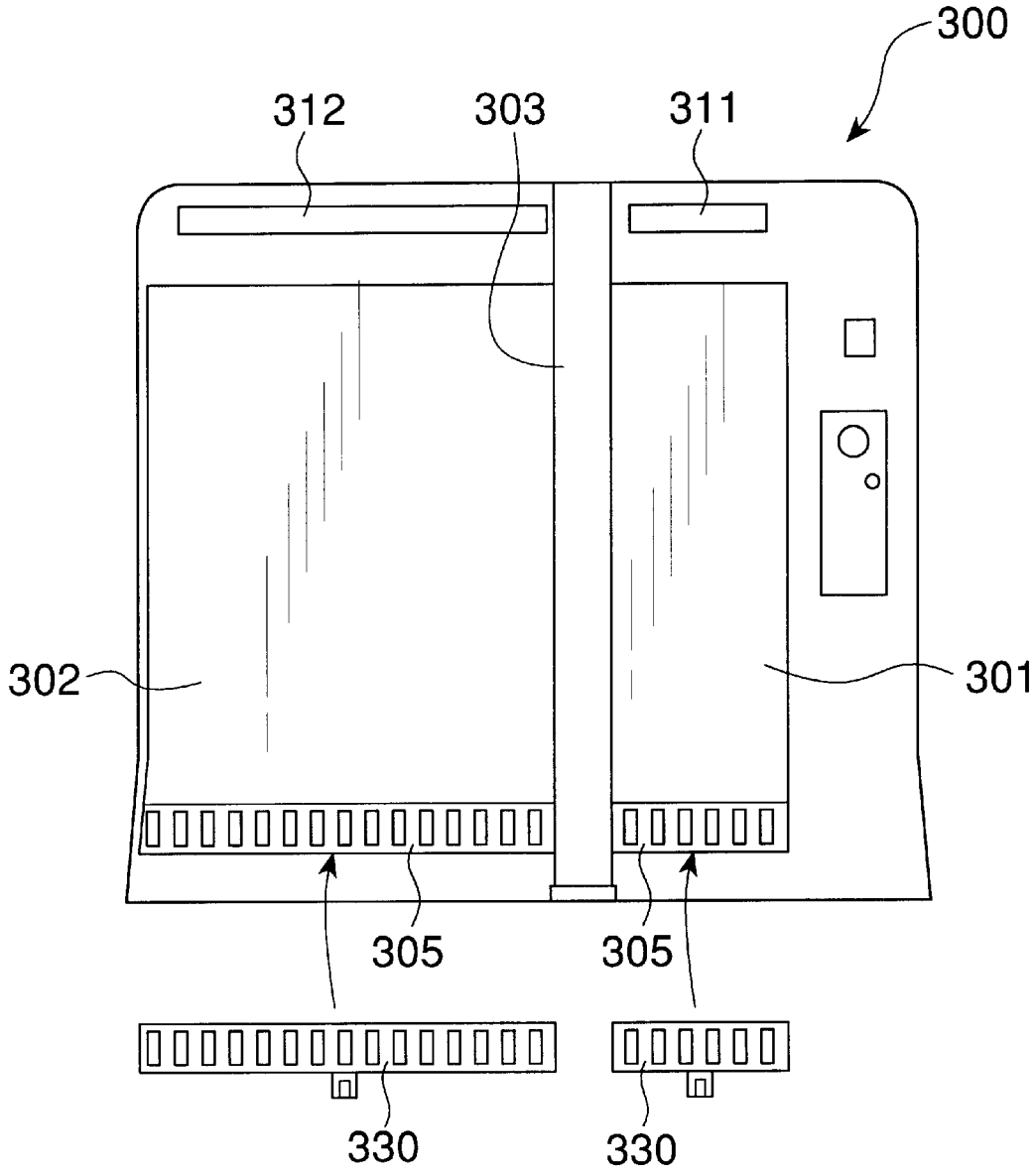
FIG. 35 is a plan view showing a vegetable compartment explained in a fourteenth embodiment according to the present invention.

Next, referring to FIGS. 35 and 36, the description will be made of a fourteenth embodiment concerning temperature adjustment within the vegetable compartment 300. FIG. 35 is a plan view showing the vegetable compartment 300, and the underside of the sheet plane is the door D side. As described above, the interior of the vegetable compartment 300 is divided into the low-temperature vegetable compartment 301 and the high-temperature vegetable compartment 302 by means of a partition wall 303, and on the back surface side of each of those vegetable compartments 301 and 302, there are respectively formed chill supply ports 311 and 312, through which the chill from the dedicated duct 40 is supplied. Correspondingly thereto, on the door D side, there are provided ventilation ports 305 communicating to the refrigerating compartment 100 for each vegetable compartment 301, 302.

Figure 36:
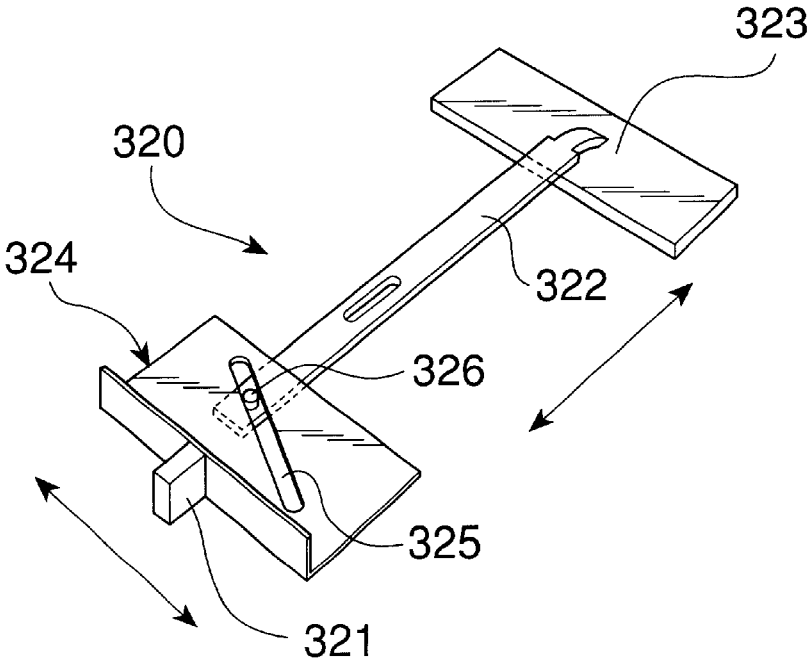
FIG. 36 is a perspective view schematically showing open-and-close means applied to the fourteenth embodiment.

Each vegetable compartment 301, 302 is provided with open-close means 320 shown in FIG. 36 in order to adjust an opening ratio of the chill supply port 311, 312. The open-close means may be a damper, but in this embodiment, there has been adopted the above-described open-close means 320 requiring simpler structure than the damper.

More specifically, this open-close means 320 includes, a knob 321 slidable in the lateral direction on this side (door D side) of the vegetable compartment 300, a stay 322 extending between the knob 321 and the chill supply port 311, 312 and slidably supported by, for example, the inside partition wall 304, which is a ceiling of the vegetable compartment 300, and a shutter plate 323 mounted to a rear end of the stay 322, and the knob 321 and the stay 322 are coupled through a plate cam 324. The shutter plate 323 is slidably mounted onto the chill supply port 311, 312 through a guide rail (not shown).

The plate cam 324 has a cam groove 325 formed in a slanting direction, and is provided, on the stay 322 side, with a boss 326 as a cam follower for the cam groove 325. By means of this cam mechanism, movement of the knob 321 in the lateral direction is transmitted to the shutter plate 323 through the stay 322 as straight-line movement crossing perpendicularly therewith, whereby the opening ratio of the chill supply port 311, 312 is appropriately adjusted. In this respect, the open-close means 320 is not always required to be provided for both the low-temperature vegetable compartment 301 and the high-temperature vegetable compartment 302, but can be provided for the vegetable compartment side which requires delicate temperature adjustment.

Each ventilation port 305 side for the low-temperature vegetable compartment 301 and the high-temperature vegetable compartment 302 is also provided with a shutter plate 330 for adjusting an amount of chill returned respectively. In this case, since on the ventilation port 305, a plurality of through-holes formed into a rectangular slice have been arranged in a line, a perforated plate having as many through-holes formed into a rectangular slice as those through-holes is also used for the shutter plate 330, and the shutter plate 330 is caused to slide in the lateral direction, whereby the opening ratio of the ventilation port 305 is adjusted.

Figure 37:
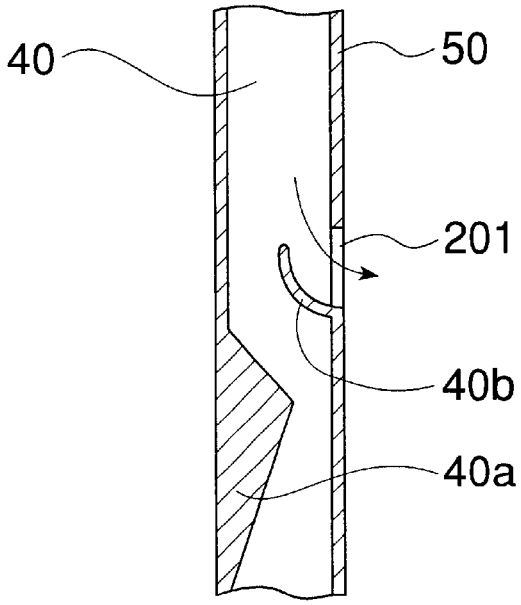
FIG. 37 is a partial sectional view showing a dedicated duct in the fourteenth embodiment.

In this respect, FIG. 37 shows a partial cross section of the dedicated duct 40, and on the back surface side of the chill supply port 201 of the switchable compartment 200, there may be formed a hood 40*b* for directing the chill toward within the switchable compartment 200. Also, it is possible to form a flow rate diaphragm 40*a* within the dedicated duct 40 for adjusting an amount of chill to be directed toward the vegetable compartment 300.

Figure 38:
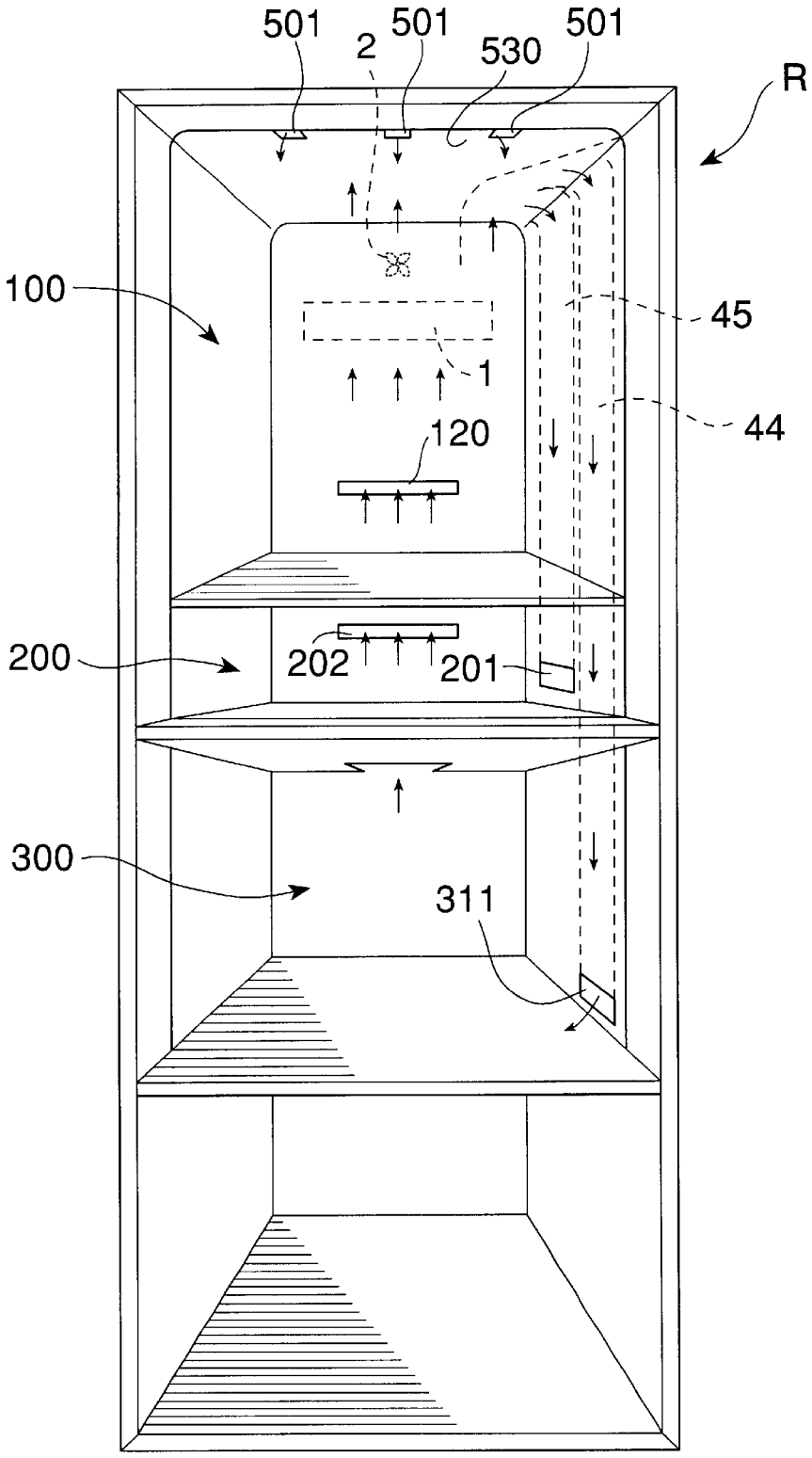
FIG. 38 is a front view when an interior of a fifteenth embodiment according to the present invention is viewed from the door side.
Figure 39:
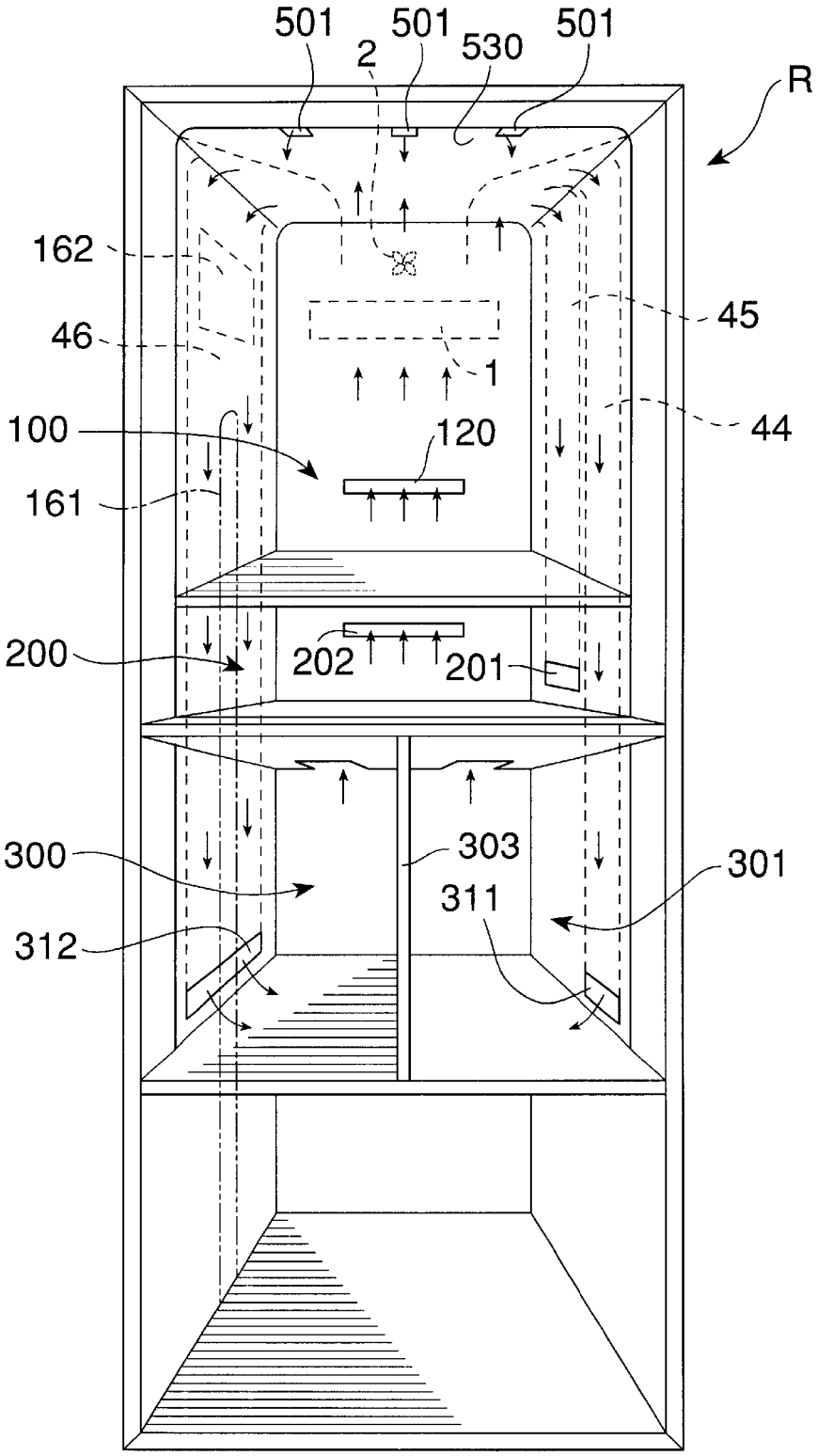
FIG. 39 is a front view when an interior of a sixteenth embodiment according to the present invention is viewed from the door side.
Figure 40:
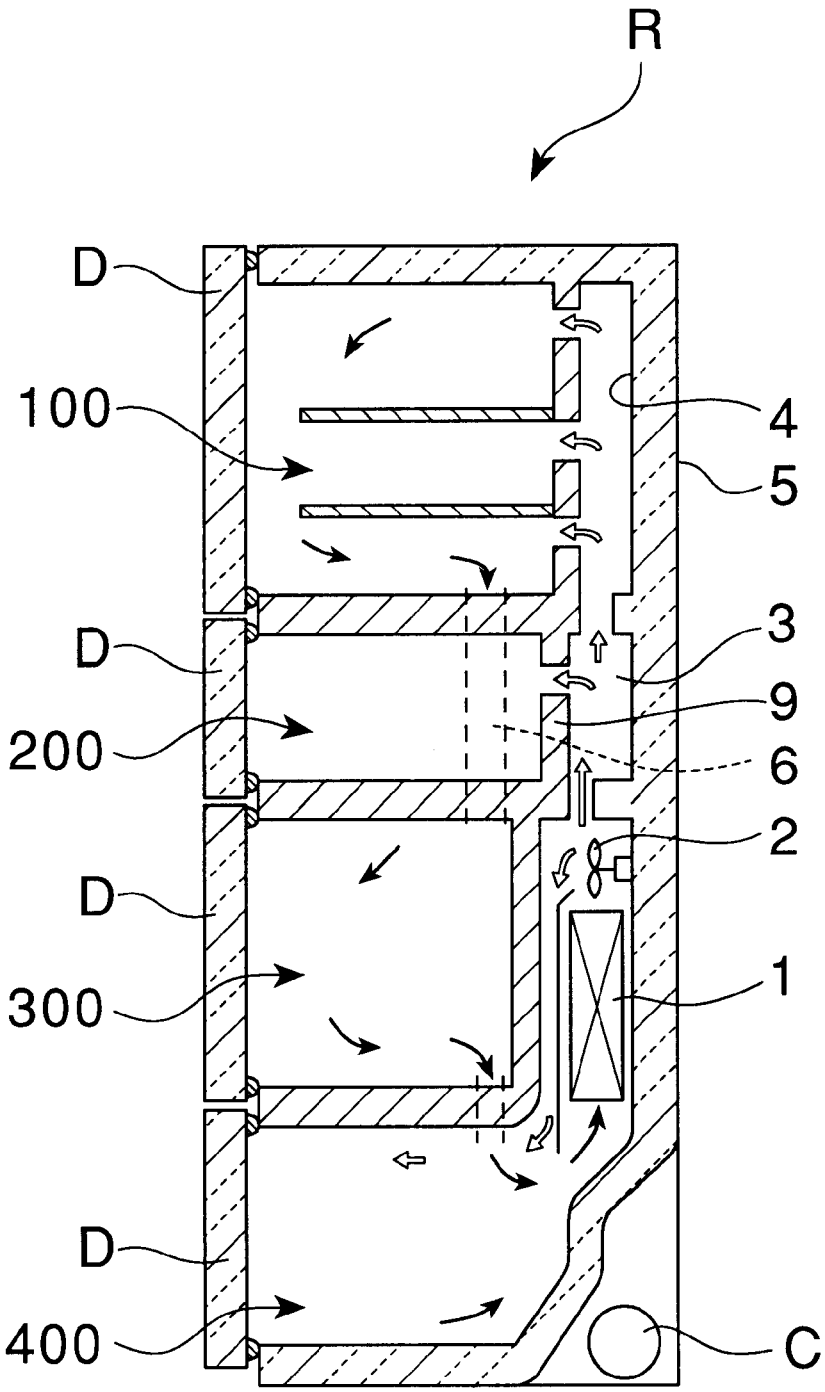
FIG. 40 PRIOR ART
FIG. 40 is a sectional view schematically showing the conventional example.

Next, the description will be made of a fifteenth embodiment of FIG. 38 and a sixteenth embodiment of FIG. 39. In either of these embodiments, the dedicated duct has been arranged on the side within the compartment instead of the back surface side within the compartment. FIGS. 38 and 39 are views showing the interior of the compartment as viewed from the front, and detailed points are omitted.

First, in the fifteenth embodiment of FIG. 38, a vegetable compartment dedicated duct 44 and a switchable compartment dedicated duct 45 are branched from a top surface duct 530 as a separate duct respectively, and are conducted to the vegetable compartment 300 and the switchable compartment 200 along, for example, the right side within the compartment. In this respect, this side duct is also formed of the duct cover and the inner case. Each dedicated duct 44, 45 is caused to run along the side within the compartment as described above, whereby the internal capacity of the compartment can be efficiently utilized. In this respect, it may be possible to make the dedicated ducts 44 and 45 into one as a mixing duct for both the vegetable compartment 300 and the switchable compartment 200.

In the sixteenth embodiment of FIG. 39, since the vegetable compartment 300 is divided into the low-temperature vegetable compartment 301 and the high-temperature vegetable compartment 302, in addition to the duct structure explained in the fifteenth embodiment, a high-temperature vegetable compartment dedicated duct 46 is branched from the top surface duct 530, and the duct 46 is further provided along, for example, the left side within the compartment. In this respect, in this sixteenth embodiment, the vegetable compartment dedicated duct 44 is used as a duct for the low-temperature table compartment 301.

In this respect, according to this sixteenth embodiment, within the high-temperature vegetable compartment dedicated duct 46, a portion of condensation pipe 161 is guided through in order to regulate the temperature and to prevent condensation, and there is contained a control circuit substrate 162 having heating components.

With reference to each of the above-described embodiments, the description has been made of the present invention, but the present invention is not limited to these embodiments. The range of the present invention should include variations which are actually regarded as identical or equal to each component element.

What is claimed is:

1. A refrigerator comprising, partition walls, a main compartment vertically partitioned into a plurality of spaces by means of the partition walls, one of the spaces at an uppermost part forming a refrigerating compartment, the other spaces in lower parts forming other storing compartments including a vegetable compartment and a freezer compartment, doors formed at the respective refrigerating compartment and storing compartments, a duct formed in the main compartment, extending from a back surface side of said main compartment over a top surface side, and containing a blower and a heat exchanger therein, a chilled air blow-off port formed at one end of said duct on a top surface side and having an opening located only at an upper part of a front surface of said refrigerating compartment on a door side, a plurality of shelf plates vertically partitioning the refrigerating compartment into storage portions to have independent air flow paths, and a plurality of first chilled air return ports formed in a back wall of the refrigerating compartment in each of the storage portions except for an uppermost storage portion, communicating to said duct, and being arranged along a vertical direction, chilled air generated by said heat exchanger flowing from the front surface side facing said door within said refrigerating compartment through the independent air flow paths of the refrigerating compartment toward a rear side, and being returned to the duct through each of the first chilled air return ports even when the door of the refrigerating compartment is closed.

2. The refrigerator according to claim 1, further comprising a second chilled air return port formed on a back wall of the vegetable compartment, and communicating to said duct, said chilled air being supplied through said refrigerating compartment into the vegetable compartment, and being returned to said duct through said second chilled air return port of said vegetable compartment.

3. The refrigerator according to claim 2, further comprising a ventilation port formed in at least one of the partition walls in front of said refrigerating compartment and storing compartments on a door side, said ventilation port being provided with a shutter for adjusting its aperture area.

4. The refrigerator according to claim 1, further comprising a dedicated duct formed in the vegetable compartment for supplying the chilled air, said chilled air being returned from said first chilled air return port of said refrigerating compartment to said duct through said refrigerating compartment.

5. The refrigerator according to claim 4, further comprising deodorizing means formed in a passage that the chilled air flows from said vegetable compartment to said refrigerating compartment.

6. The refrigerator according to claim 1, wherein said blower and said heat exchanger are arranged in an upper part of said refrigerating compartment on the back surface side.

7. The refrigerator according to claim 6, further comprising shelf plates for Vertically Partitioning an interior of said refrigerating compartment into a plurality of storage portions, said storage portions except the storage portion at an uppermost Position being provided with said first chilled air return ports, said storage portion at the uppermost Position communicating to the other storage portions through a ventilation port.

8. The refrigerator according to claim 7, wherein said ventilation port IS formed of a clearance having a predetermined width and provided between said shelf plate at the uppermost position and the back wall of said refrigerating compartment.

9. The refrigerator according to claim 7, wherein said shelf plate at the uppermost position has a rear end curved upwardly at a predetermined curvature, and said ventilation port is formed on said curved rear end.

10. The refrigerator according to claim 7, wherein said shelf plate at the uppermost position has a side wall having a predetermined width at a rear end of the shelf plate, said side wall projecting in a U-character shape in cross section upwardly, said ventilation port being formed on a top surface of the side wall.

11. The refrigerator according to claim 1, wherein said blower and said heat exchanger are arranged in an upper portion of said refrigerating compartment on the back surface side; a second chilled air return port communicating to said duct is formed on a rear wall of the vegetable compartment; and a back portion of said duct is divided into a refrigerating compartment return duct for guiding the chilled air from said refrigerating compartment to a suction side of said heat exchanger and a vegetable compartment return duct for guiding the chilled air from said vegetable compartment to the suction side of said heat exchanger.

12. The refrigerator according to claim 11, further comprising shelf plates for vertically partitioning an interior of said refrigerating compartment into a plurality of storage portions, each of at least second stage and subsequent storage portions from above being provided with said first chill return ports on left and right sides, said refrigerating compartment return ducts being provided on left and right sides of said back surface duct, and therebetween, said vegetable compartment return duct being arranged.

13. The refrigerator according to claim 12, wherein the interior of said refrigerating compartment return duct is divided into portions corresponding to each of said first chilled air return ports in each of said storage portions.

14. The refrigerator according to claim 6, further comprising shelf plates for vertically partitioning an interior of said refrigerating compartment into a plurality of storage portions, the storage portion at an uppermost position having an upper wall provided with a third chilled air return port communicating to a top surface duct within said duct.

15. The refrigerator according to claim 14, wherein an interior of said top surface duct is divided into a chilled air supply duct extending from an air supply side of said heat exchanger toward said chilled air blow-off port, and a chilled air return duct for guiding the chilled air returned from said third chilled air return port to a suction side of said heat exchanger.

16. The refrigerator according to claim 1, further comprising a second chilled air return port formed on a back wall of the vegetable compartment, and communicating to said duct, said blower and said heat exchanger being arranged on a back surface side of said vegetable compartment in a lower part within a back surface duct of said duct, an interior of said back surface duct being divided into a chilled air supply duct extending from an air supply side of said heat exchanger toward said chilled air blow-off port, and a refrigerating compartment return duct for guiding the chilled air from said first chilled air return port of said refrigerating compartment to a suction side of said heat exchanger.

17. The refrigerator according to claim 16, wherein the chilled air in said vegetable compartment is conducted from said second chilled air return port to the suction side of said heat exchanger.

18. The refrigerator according to claim 17, further comprising shelf plates for vertically partitioning the interior of said refrigerating compartment into a plurality of storage portions, each of at least second stage and subsequent storage portions from above being provided with said first chilled air return ports on left and right sides, said refrigerating compartment return duct being provided on left and right sides of said back surface duct, and said chilled air supply duct being arranged therebetween.

19. The refrigerator according to claim 1, further comprising a second chilled air return port formed on a back wall of the vegetable compartment and communicating to said duct, said blower and said heat exchanger being arranged on the back surface side of said vegetable compartment in a lower part within a back surface duct of said duct, an interior of said back surface duct being divided into a first chilled air supply duct extending from an air supply side of said heat exchanger toward said chilled air blow-off port, and a second chilled air supply duct for conducting the chilled air from said first chilled air return port of said refrigerating compartment toward said chilled air blow-off port.

20. The refrigerator according to claim 19, further comprising shelf plates for vertically partitioning an interior of said refrigerating compartment into a plurality of storage portions, an upper wall of the storage portion at an uppermost position being provided with a third chilled air return port communicating to a top surface duct within said duct.

21. The refrigerator according to claim 20, wherein an interior of said duct is divided into the first chilled air supply duct extending from an air supply side of said heat exchanger toward said chilled air blow-off port, and the second chilled air supply duct for conducting the chilled air from said first chilled air return port and said third chilled air return port toward said chilled air blow-off port.

22. The refrigerator according to claim 20, wherein an interior of said duct is divided into a chilled air supply duct extending from an air supply side of said heat exchanger toward said chilled air blow-off port, and a chilled air return duct for conducting the chilled air from said first chilled air return port and said third chilled air return port to the suction side of said heat exchanger.

23. The refrigerator according to claim 20, wherein the chilled air from said third chilled air return port is conducted to said chilled air blow-off port side, while the chilled air from said first chilled air return port is conducted to the suction side of said heat exchanger.

24. The refrigerator according to claim 23, further comprising a shielding plate provided between a chilled air supply duct including said third chilled air return port and a chilled air return duct including said first chilled air return port.

25. The refrigerator according to claim 12, wherein said vegetable compartment return duct has a sectional area larger than that of said refrigerating compartment return duct.

26. The refrigerator according to claim 18, wherein said chilled air supply duct has a sectional area larger than that of said refrigerating compartment return duct.

27. The refrigerator according to claim 1, wherein an interior of said duct is divided into portions in a back-and-forth direction as viewed from a side of said main compartment.

28. A refrigerator comprising, partition walls, a main compartment partitioned into a plurality of spaces by the partition walls, one of the spaces at an uppermost part forming a refrigerating compartment, and the other spaces in lower parts forming other storing compartments including vegetable compartments and a freezer compartment, said vegetable compartments having a low-temperature vegetable compartment and high-temperature vegetable compartment through a partition, a back surface duct and a top surface duct continuously formed from a back surface side of the main compartment over an upper surface side, a duct provided at one end of the top surface duct and having a chilled air blow-off port opened in an upper part of a front surface of said refrigerating compartment and a chilled air return port communicating with the back surface duct on a back wall of the refrigerating compartment, and a blower and a heat exchanger arranged in an upper part of the refrigerating compartment on a back surface side within the duct for supplying chilled air, said chilled air supplied from said blower being partially conducted through dedicated ducts into the respective vegetable compartments, the chilled air in each of said refrigerating compartment and said storing compartments being returned to a heat exchanger side through said back surface duct.

29. The refrigerator according to claim 28, wherein each of said dedicated ducts is made of thermal insulating material, and is extended from said blower to said low-temperature vegetable compartment and said high-temperature vegetable compartment within said back surface duct.

30. The refrigerator according to claim 28, wherein each of said dedicated ducts is branched from said top surface duct, and is extended to said low-temperature vegetable compartment and said high-temperature vegetable compartment along a side of said main compartment.

31. The refrigerator according to claim 28, further comprising a condensation pipe having a portion guided into the dedicated duct of the high-temperature vegetable compartment.

32. The refrigerator according to claim 28, further comprising a control circuit substrate having heating components arranged in the dedicated duct of the high-temperature vegetable compartment.

33. The refrigerator according to claim 28, wherein said blower is a cross flow fan; one end of said dedicated duct is arranged at a portion of an air supply port on one end side of the blower; and said dedicated duct is conducted downward along a side of said heat exchanger.

34. The refrigerator according to claim 28, wherein said blower is a cross flow fan; one end of said dedicated duct is arranged at a portion of an air supply port on one end side of the blower; and said dedicated duct passes in front of said heat exchanger is conducted downward.

* * * * *